US010185251B2

(12) United States Patent
Nonaka et al.

(10) Patent No.: US 10,185,251 B2
(45) Date of Patent: Jan. 22, 2019

(54) REPRODUCTION METHOD FOR DEVELOPING DEVICE

(71) Applicant: CANON KABUSHIKI KAISHA, Tokyo (JP)

(72) Inventors: Fumito Nonaka, Mishima (JP); Hiroomi Matsuzaki, Mishima (JP); Seiichi Shinohara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/634,388

(22) Filed: Jun. 27, 2017

(65) Prior Publication Data

US 2018/0004125 A1 Jan. 4, 2018

(30) Foreign Application Priority Data

Jul. 4, 2016 (JP) ..... 2016-132392
Jul. 4, 2016 (JP) ..... 2016-132399

(51) Int. Cl.
*G03G 15/08* (2006.01)
*G03G 21/18* (2006.01)

(52) U.S. Cl.
CPC ..... *G03G 15/0894* (2013.01); *G03G 15/081* (2013.01); *G03G 21/181* (2013.01); *G03G 21/1821* (2013.01)

(58) Field of Classification Search
CPC ..... G03G 15/0894; G03G 15/0881; G03G 21/181; G03G 21/1821; G03G 2215/00987
See application file for complete search history.

(56) References Cited

U.S. PATENT DOCUMENTS

| | | | |
|---|---|---|---|
| 5,937,237 | A | 8/1999 | Nonaka et al. |
| 5,943,529 | A | 8/1999 | Miyabe et al. |
| 5,966,567 | A | 10/1999 | Matsuzaki et al. |
| 6,011,941 | A | 1/2000 | Takashima et al. |
| 6,097,906 | A | 8/2000 | Matsuzaki et al. |
| 6,101,348 | A | 8/2000 | Nonaka et al. |
| 6,128,462 | A | 10/2000 | Kato et al. |
| 6,144,815 | A | 11/2000 | Chadani et al. |
| 6,169,869 | B1 | 1/2001 | Inami et al. |
| 6,173,140 | B1 | 1/2001 | Suzuki et al. |
| 6,173,145 | B1 | 1/2001 | Chadani et al. |

(Continued)

FOREIGN PATENT DOCUMENTS

| | | | |
|---|---|---|---|
| JP | 2004188553 A | * | 7/2004 |
| JP | 2013-134299 A | | 7/2013 |
| JP | 5460824 B2 | | 4/2014 |

OTHER PUBLICATIONS

Machine Translation of JP 2004-188553. Jul. 8, 2004.*
Extended Search Report in European Patent Application No. 17 17 8961.3, dated Nov. 15, 2017.

*Primary Examiner* — Carla Therrien
(74) *Attorney, Agent, or Firm* — Venable LLP

(57) ABSTRACT

The engagement between a fixing member and a resin member is released and the resin member is separated from a frame thereby separating a bearing member from the frame. Parts to be used in a developing device are replaced or the developing device is replenished with a developer. The resin member is connected to the frame to connect the bearing member to the frame. The fixing member is inserted into a through hole to engage with the resin member and fix the resin member to the frame, thereby fixing the bearing member to the frame.

8 Claims, 31 Drawing Sheets

(56) References Cited

U.S. PATENT DOCUMENTS 6,175,703 B1 1/2001 Nakazono et al.
6,205,305 B1 3/2001 Suzuki et al.
6,219,504 B1 4/2001 Matsuzaki et al.
6,282,389 B1 8/2001 Matsuzaki et al.
6,317,574 B1 11/2001 Shinohara et al.
6,337,964 B2 1/2002 Inami et al.
6,405,004 B2 6/2002 Matsuzaki et al.
6,549,736 B2 4/2003 Miyabe et al.
6,792,229 B2 9/2004 Matsuzaki
6,795,666 B2 9/2004 Miyabe et al.
6,826,380 B2 11/2004 Karakama et al.
6,931,226 B2 8/2005 Chadani et al.
6,934,485 B2 8/2005 Miyabe et al.
6,978,100 B2 12/2005 Yasui et al.
6,992,534 B2 1/2006 Lin
7,082,276 B2 7/2006 Karakama et al.
7,155,137 B2 12/2006 Yasui et al.
7,224,925 B2 5/2007 Sato et al.
7,349,657 B2 3/2008 Sato et al.
7,412,193 B2 8/2008 Sato et al.
7,865,115 B2 1/2011 Oguma et al.
8,867,955 B2 10/2014 Yamaguchi et al.
8,879,945 B2 11/2014 Nonaka et al.
8,879,954 B2 11/2014 Nonaka et al.
8,909,096 B2 12/2014 Fukui et al.
9,069,291 B2 6/2015 Hoshi et al.
9,098,062 B2 8/2015 Shinohara
9,128,417 B2 9/2015 Yamasaki et al.
9,146,500 B2 9/2015 Uesugi et al.
9,152,081 B2 10/2015 Yasui et al.
9,188,906 B2 11/2015 Batori et al.
9,188,940 B2 11/2015 Fukui et al.
9,207,581 B2 12/2015 Wada et al.
9,280,135 B2 3/2016 Nonaka
9,291,942 B2 3/2016 Matsuzaki et al.
9,304,439 B2 4/2016 Matsuzaki et al.
9,354,553 B2 5/2016 Yoshida et al.
9,360,831 B2 6/2016 Matsuzaki et al.
9,377,716 B2 6/2016 Yamasaki et al.
9,383,678 B2 7/2016 Furutani et al.
9,494,890 B2 11/2016 Komatsu et al.
9,529,304 B2 12/2016 Uesugi et al.
9,529,306 B2 12/2016 Hoshi et al.
9,599,930 B2 3/2017 Matsuzaki et al.
9,665,040 B2 5/2017 Matsuzaki et al.
2005/0146857 A1* 7/2005 Finneman ..... H05K 7/12
361/740
2005/0232654 A1 10/2005 Karakama et al.
2005/0281580 A1 12/2005 Lewis et al.
2013/0164029 A1 6/2013 Fukui et al.
2013/0177334 A1 7/2013 Nonaka et al.
2016/0306299 A1* 10/2016 Daniels ..... G03G 15/0894
2016/0357142 A1 12/2016 Hoshi et al.
2017/0003622 A1 1/2017 Matsuzaki
2017/0212452 A1 7/2017 Matsuzaki et al.
2017/0235251 A1 8/2017 Matsuzaki et al.

* cited by examiner

SECTIONAL VIEW ALONG LINE A-A

SECTIONAL VIEW ALONG A-A

REPRODUCTION METHOD FOR DEVELOPING DEVICE

BACKGROUND OF THE INVENTION

Field of the Invention

The present invention relates to a reproduction method for a developing device for developing an electrostatic latent image formed on a photosensitive drum.

Description of the Related Art

In an image forming apparatus using the electrophotographic technique, first, a photosensitive drum is uniformly charged by a charging roller. Next, the charged photosensitive drum is selectively exposed to form an electrostatic latent image on the photosensitive drum. Then, the electrostatic latent image formed on the photosensitive drum is developed as a toner image by a developing device. The toner image formed on the photosensitive drum is transferred to a recording material such as recording paper or a plastic sheet, and the toner image transferred onto the recording material is fixed to the recording material by heating/pressurizing. Further, the toner remaining on the photosensitive drum after the toner image on the photosensitive drum has been transferred to the recording material is removed by a cleaning blade.

In such an image forming apparatus, it is generally necessary to replenish the toner and to maintain various process means. In order to facilitate toner replenishment and maintenance, process cartridges in which process means such as a photosensitive drum, a charging roller, a developing device, and a cleaning blade are integrated as a cartridge have been put to practical use. Since this process cartridge is detachably attached to the main body of the image forming apparatus, replacement of the process means and replenishment of the toner can be easily carried out by replacing the process cartridge.

With such a process cartridge system, maintenance of the image forming apparatus can be performed by the user himself, so that the operability can be greatly improved and an image forming apparatus excellent in usability can be provided. For this reason, the process cartridge system is widely used in image forming apparatuses.

Here, a conventional process cartridge will be described. A photosensitive member unit C has a cleaning frame 13 integrally supporting a photosensitive drum 10, a charging roller 11, and a cleaning blade 12. Further, a developing unit D has a developing frame 21 that integrally supports a developing roller 23, a supply roller 22, and a developing blade 24 as a regulating member and constitutes a developer storing unit 20 that stores a developer. The developing roller 23 carries the developer for developing an electrostatic latent image formed on the photosensitive drum 10, and the supply roller 22 serves for supplying the developer to the developing roller 23. Further, the developing blade 24 serves for regulating the layer thickness of the developer borne on the developing roller 23. The developing unit D includes a bearing member 31 and a bearing member 39 for supporting the developing roller 23 and the supply roller 22 at both ends of the developing frame 21 in the direction of the rotation center axis of the developing roller 23 and the supply roller 22.

Here, the technique disclosed in Japanese Patent No. 5460824 will be described. In the technique disclosed in Japanese Patent No. 5460824, a hole having an opening in the axial direction is provided at the end of the developing frame 21 in the direction of the rotation center axis of the developing roller 23 and the supply roller 22. The developing blade 24 is fixed to the developing frame 21 with screws 50, and the tip of each screw 50 projects into the hole. In addition, the bearing member 31 is provided with a through hole. In this way, in a state in which the bearing member 31 is attached to the developing frame 21, the hole of the developing frame 21 and the through hole of the bearing member 31 communicate with each other. Further, in a state where the hole of the developing frame 21 and the through hole of the bearing member 31 communicate with each other, a molten conductive resin is injected from the through hole of the bearing member 31 and solidifies in a space formed by the hole of the developing frame 21 and the through hole of the bearing member 31. With the technique disclosed in Japanese Patent No. 5460824, the bearing member 31 and the developing frame 21 are joined by using the conductive resin in this manner. As a result, the productivity in manufacture of the developing unit D is improved. Further, the resin molded portion formed by solidifying the conductive resin is electrically connected to the developing blade 24. Therefore, electric power can be fed to the developing blade 24 by feeding electric power to the power feeding position in the resin molded portion.

The technique disclosed in Japanese Patent Application Publication No. 2013-134299 will be described hereinbelow. In the technique disclosed in Japanese Patent Application Publication No. 2013-134299, a method of disassembling (separating) the bearing member 31 and the developing frame 21 is disclosed. Specifically, in the technique disclosed in Japanese Patent Application Publication No. 2013-134299, the screws 50 are inserted from the outer wall of the developing frame 21 toward a cylindrical hole formed at the end of the developing frame 21. As a result, the screws 50 protrude in a direction orthogonal to the axial direction of the hole in the conductive resin molded portion formed in the hole of the developing frame 21. In the technique disclosed in Japanese Patent Application Publication No. 2013-134299, the conductive resin molded portion is fixed to the bearing member 31 and is fixed to the developing frame 21 only by the screws 50. Therefore, the conductive resin molded portion can be disengaged from the developing frame 21, and the bearing member 31 and the developing frame 21 can be easily disassembled by detaching only the screws 50. Further, in the related art, the disassembled bearing member 31, developing frame 21, and the like are used again as materials.

SUMMARY OF THE INVENTION

However, when the bearing member 31, the developing frame 21, and the like are used again as materials, it is necessary to cut finely and melt the bearing member 31 and the developing frame 21. It is then necessary to mold the molten material again using a mold. Therefore, it takes time and cost to reuse the disassembled bearing member 31, the developing frame 21, and the like as materials.

Accordingly, it is an object of the present invention to provide a method capable of reproducing a developing device without taking time and cost.

The inventors of the present invention have investigated the feature of inserting the screws 50 again into the holes formed when the screws 50 were pulled out from the conductive resin molded portion after the bearing member 31 and the developing frame 21 were disassembled, and thus fixing the disassembled developing frame 21 and the conductive resin molded portion to each other.

As a result, it was established that when the screws 50 are reused and the reused screws 50 are fitted into the holes formed in the conductive resin molded portion, the screws 50 may become loose with respect to the conductive resin molded portion. When the screws 50 are loose with respect to the conductive resin molded portion, the conductive resin molded portion is not accurately positioned with respect to the developing frame 21. For this reason, the developing frame 21 cannot be accurately positioned with respect to the bearing member 31. In other words, it was found that the developing roller 23 may be inaccurately positioned with respect to the developing frame 21, and that the electrostatic latent image formed on the photosensitive drum 10 may not be developed with satisfactory accuracy.

It is therefore another object of the present invention to provide a reproduction method for a developing device that enables accurate positioning of the bearing member with respect to the developing frame when rejoining the disassembled developing frame and bearing member.

In order to attain the above object, the present invention provides a reproduction method for a developing device including:

a frame of the developing device;

a developer carrying member that carries a developer;

a bearing member that rotatably supports the developer carrying member;

a first fixing member that is provided so as to pass through a through hole provided in the frame; and a resin member that is fixed to the bearing member and engaged with the first fixing member, the reproduction method comprising:

releasing the engagement between the first fixing member and the resin member and separating the resin member from the frame;

replacing parts to be used in the developing device or replenishing the developing device with the developer;

connecting the resin member to the frame; and inserting a second fixing member into the through hole to engage with the resin member and fix the resin member to the frame, thereby fixing the bearing member to the frame.

In the present invention, it is possible to reproduce the parts constituting the developing apparatus without taking time and cost.

Further, in the present invention, it is possible to position accurately the bearing member with respect to the developing frame when rejoining the disassembled developing frame and bearing member.

Further features of the present invention will become apparent from the following description of exemplary embodiments with reference to the attached drawings.

DESCRIPTION OF THE EMBODIMENTS

Hereinafter, a description will be given, with reference to the drawings, of embodiments of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

<Image Forming Apparatus 100>

Figure 1:
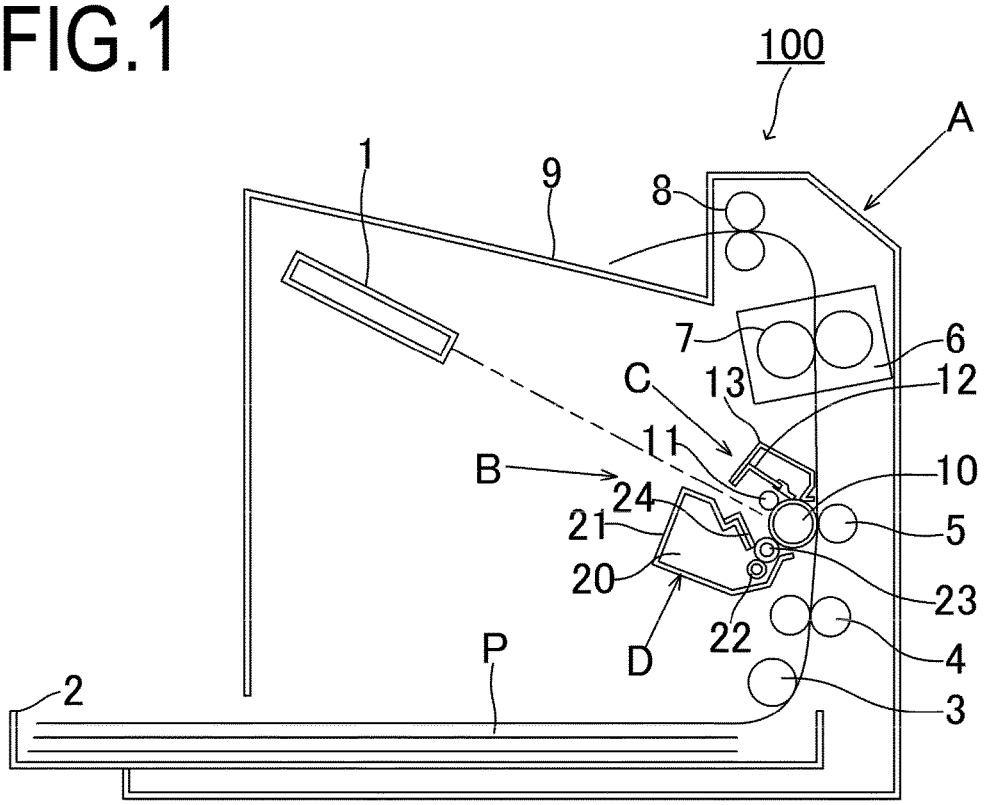
FIG. 1 is a cross-sectional view showing the overall configuration of an image forming apparatus according to Example 1.

A schematic configuration of the entire image forming apparatus 100 will be described hereinbelow following the flow of a recording medium P with reference to FIG. 1. FIG. 1 is a cross-sectional view showing the overall configuration of the image forming apparatus 100 according to Example 1. In an apparatus main body A of the image forming apparatus 100, a latent image is formed on a photosensitive drum 10 as an image bearing member by a scanner portion 1 which has received latent image data. A developer on the circumferential surface of a developing roller 23 serving as a developer carrying member is transferred to the photosensitive drum 10 in accordance with the latent image so that the latent image on the photosensitive drum 10 is visualized as a developer image. Further, the image forming apparatus 100 is provided with a paper feed cassette 2 capable of storing a recording medium P, and the recording medium P is fed one by one by a paper feed portion 3. Then, the fed recording medium P is conveyed to a registration roller 4. The developer image on the photosensitive drum 10 is transferred by a transfer roller 5 onto the recording medium P conveyed by the registration roller 4. Subsequently, the recording medium P is conveyed to a fixing unit 6, and the developer image is fixed by a fixing roller 7. Then, the recording medium P after the image has been fixed is discharged by a discharge portion 8 to a paper discharge portion 9.

<Process Cartridge B>

A process cartridge B according to the present example is configured by integrating a photosensitive member unit C and a developing unit D as a developing device into a cartridge, and can be detachably attached to the apparatus main body A. The photosensitive member unit C includes the photosensitive drum 10, a charging roller 11 as a charging means, a cleaning blade 12 as a cleaning means, and a cleaning frame 13.

The developing unit D includes the developing roller 23 as a developing means, a supply roller 22, a developing blade 24 as a regulating member, and a developing frame 21 as a frame constituting a developer storing portion 20. In this example, the developing means performs development in the following manner. First, the developer in the developer storing unit 20 is supplied to the developing roller 23 by the rotation of the supply roller 22, and the developing blade 24 regulates the layer thickness of the developer layer on the developing roller 23. Then, the developer is transferred to the photosensitive drum 10 according to the latent image, thereby forming a developer image on the photosensitive drum 10. In the cleaning means according to this example, the cleaning blade 12 removes the developer remaining on the photosensitive drum 10 after the developer image on the photosensitive drum 10 has been transferred onto the recording medium P.

<Development Unit D>

Figure 2A:
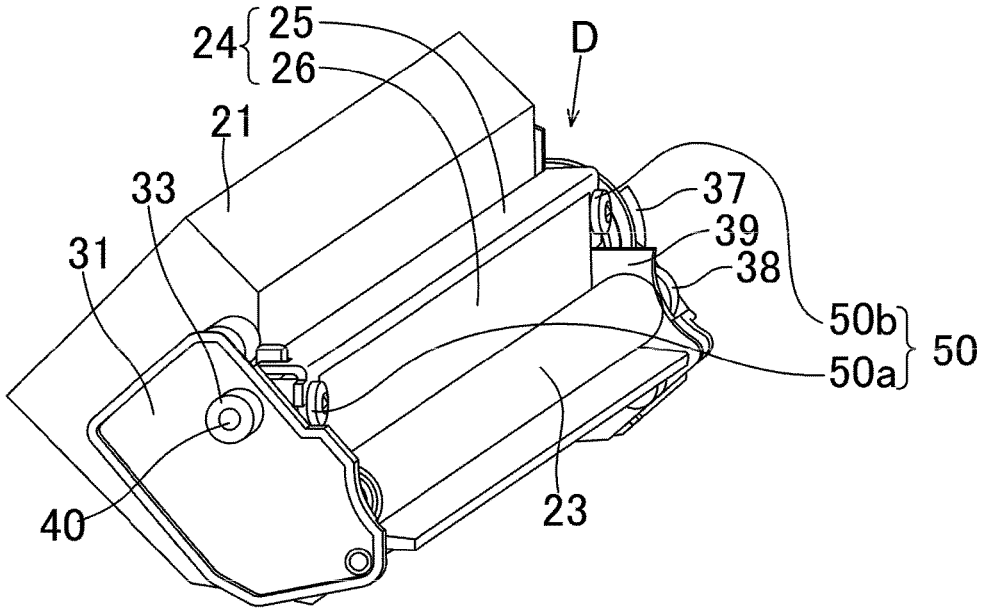
FIGS. 2A and 2B are perspective views of the developing unit according to Example 1.
Figure 2B:
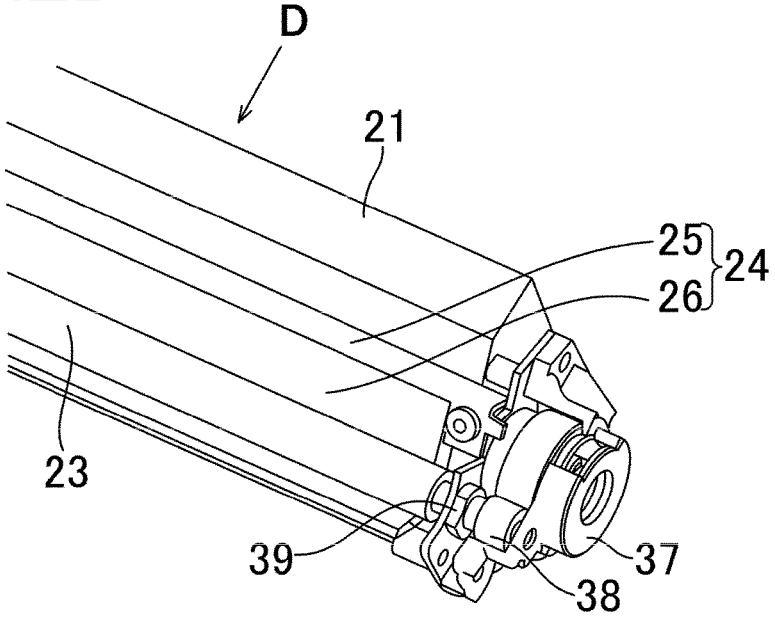
Figure 3:
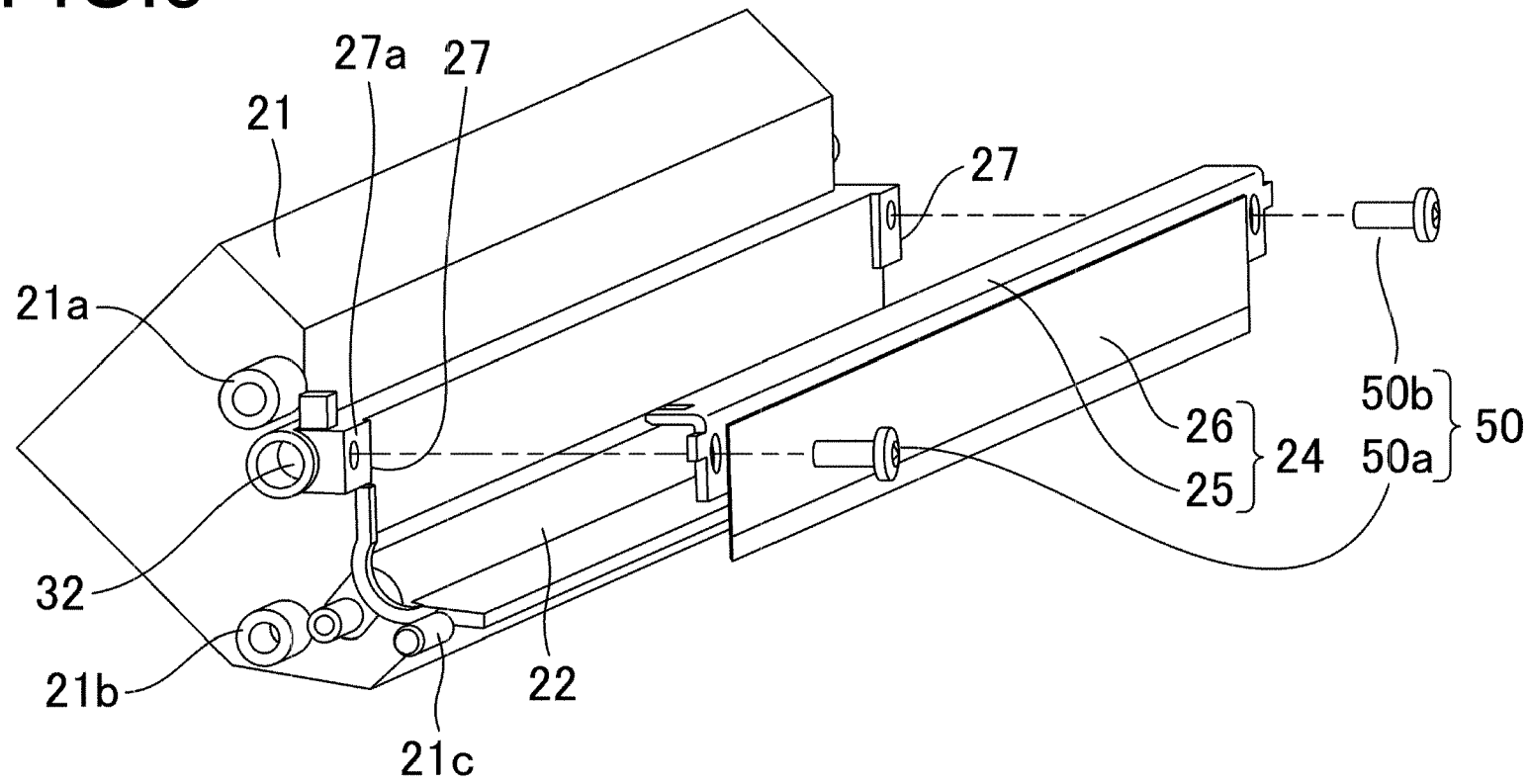
FIG. 3 is a perspective view showing how the developing blade is attached to the developing unit.

The developing unit D according to the present example will be described hereinbelow with reference to FIGS. 1, 2, and 3. FIGS. 2A and 2B are perspective views of the developing unit D, and FIG. 3 is a perspective view showing how the developing blade 24 is attached to the developing unit D. As described above, the developing unit D includes the developer, the developer storing unit 20 for storing the developer, the supply roller 22, the developing roller 23, the developing blade 24, and the developing frame 21. The developing blade 24 includes a contact portion 26 that is in contact with the developing roller 23, and a metal support sheet 25 that supports the contact region 26. An elastic member such as a rubber or a thin metal is used as the contact region 26. Here, in the present example and the conventional example, a stainless steel material having a thickness of 0.08 mm is used as the contact region 26. The developing blade 24 configured of these parts is fixed to the developing frame 21 by screws 50 (correspond to a first fixing member and a first screw member) made of a conductive material. Further, the developing roller 23 and the supply roller 22 are supported by a bearing member 31. As described above, the developing unit D may constitute a part of the process cartridge B, or it may be detachably attached as an independent unit to the apparatus main body A of the image forming apparatus 100. In this example and Examples 2 and 3 described hereinbelow, the screws 50 which have been used for manufacturing the developing unit D are also used when the developing unit D is reproduced after disassembling the developing unit D and replacing parts or replenishing the developer. In this case, the screws 50 also correspond to a second fixing member and a second screw member.

Next, the configuration of the developing unit D according to Example 1 will be described with reference to FIGS. 2 to 8. Here, in particular, a method for joining the bearing member 31 to the developing frame 21 and the configuration of the conductive path for supplying electric power to the developing blade 24 will be explained in detail by following the order of assembling the developing blade 24 and the bearing member 31. Here, FIGS. 3 to 8 are explanatory diagrams showing how the developing unit D according to the present example is assembled. In this case, the parts are assembled with the developing frame 21 in a state after the developing frame 21 has been filled with the developer and after the supply roller 22 has been assembled with the developing frame 21.

<Assembling of the Developing Blade 24>

Figure 4:
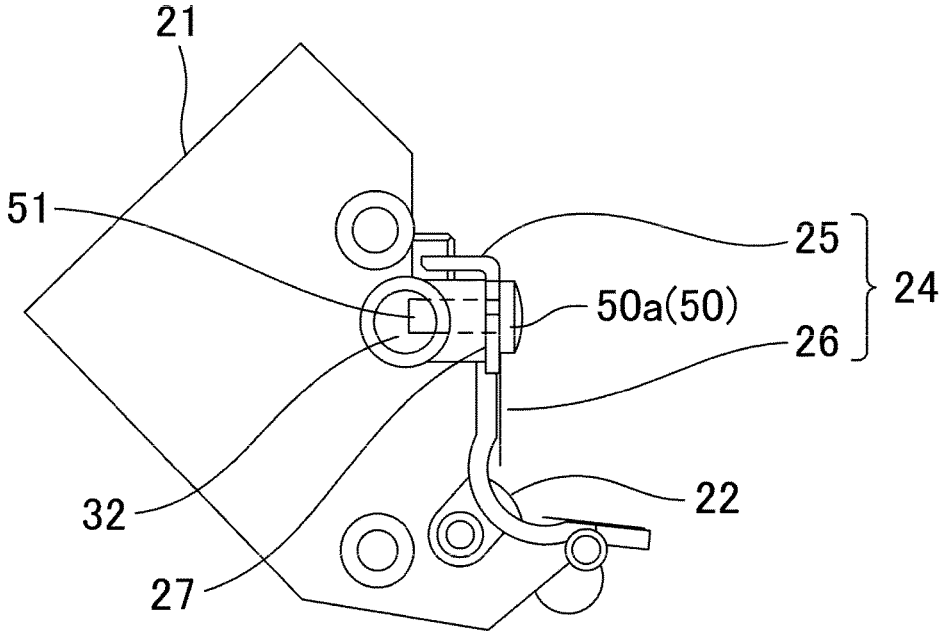
FIG. 4 is a side view showing a state in which the developing blade is attached to the developing frame.

FIG. 3 is a perspective view showing a state before the developing blade 24 is assembled with the developing frame 21. In this state, the bearing member 31 (see FIG. 2A) is not yet attached to the developing frame 21. Further, FIG. 4 is a side view showing a state in which the developing blade 24 is attached to the developing frame 21. In this state, the bearing member 31 is not yet attached to the developing frame 21.

When the developing blade 24 is assembled with the developing frame 21, firstly, the developing blade 24 is fixed with screws 50 to two seating surfaces 27 provided on the developing frame 21. Here, as shown in FIG. 3, one screw hole 27*a* (through hole) passes through in the developing frame 21 so as to communicate with a joint portion 32 provided on the joining surface with the bearing member 31. Therefore, in a state where the tightening of the screws 50 is completed, as shown in FIG. 4, a screw tip 51 protrudes into the space of the joint portion 32. Here, the process of assembling the developing blade 24 with the developing frame 21 is very important for realizing stable image formation. Therefore, the developing blade 24 may be assembled while adjusting the position of the developing blade 24 so that the developing blade 24 can be attached to a predetermined attachment position.

<Assembling of the Bearing Member 31>

Figure 5:
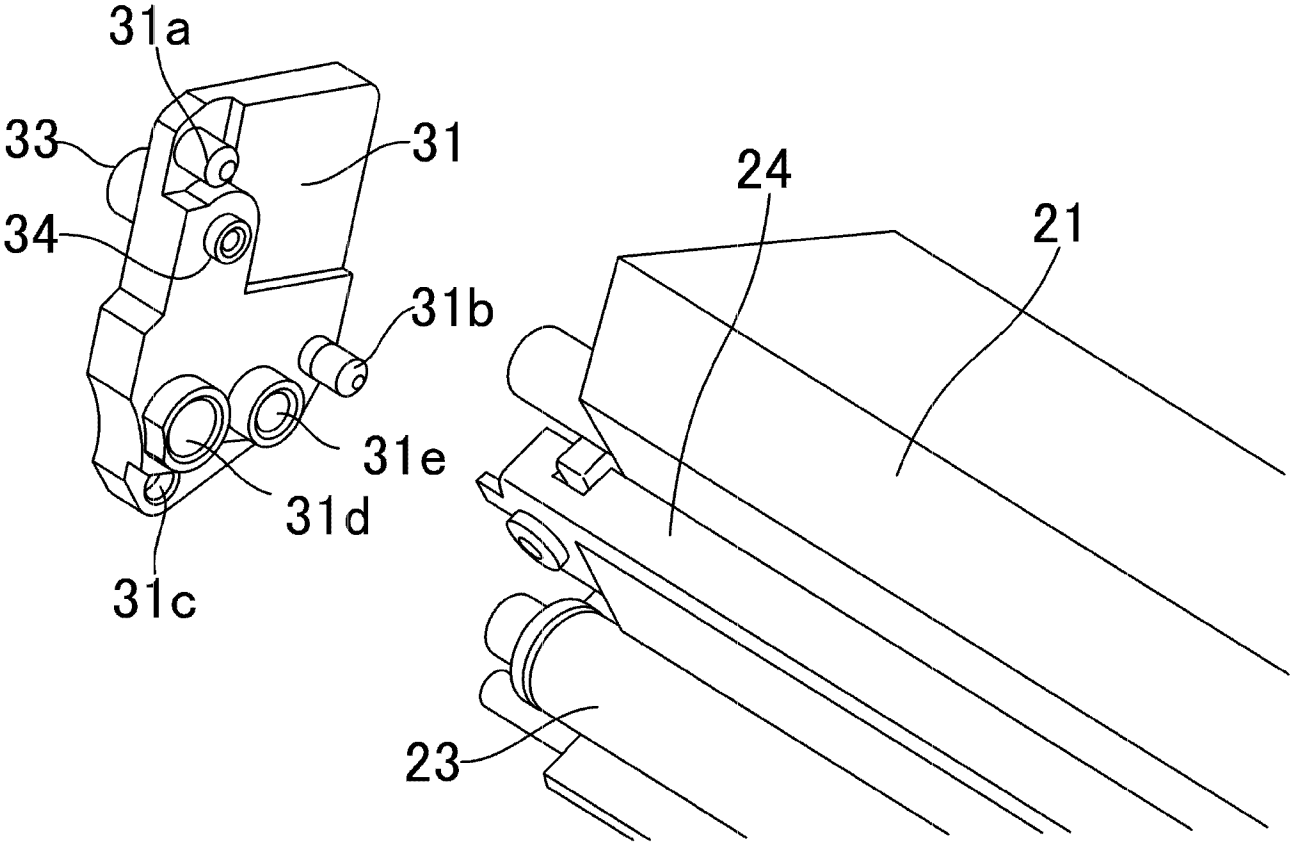
FIG. 5 is a perspective view showing a state before the bearing member is attached to the developing frame.
Figure 6B:
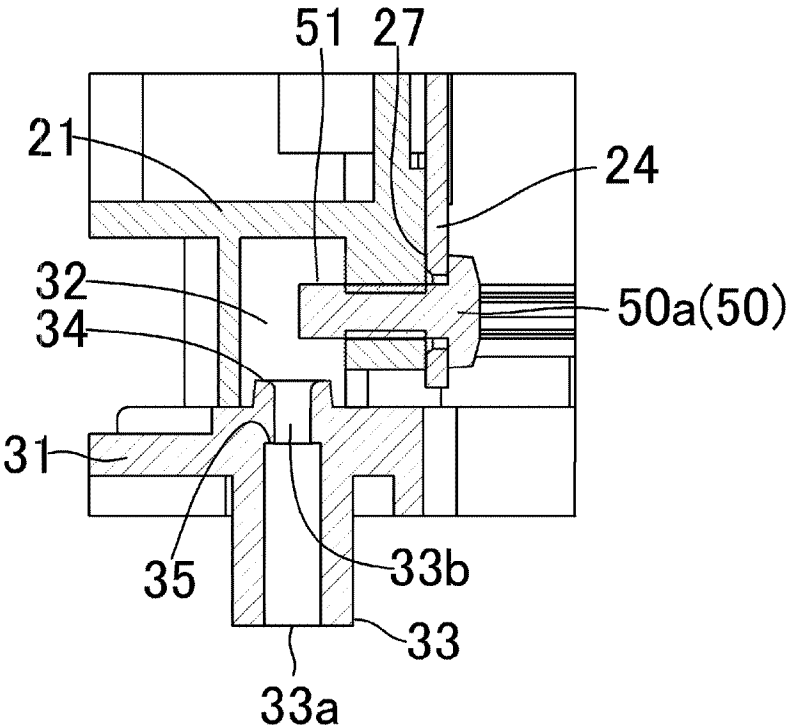
FIGS. 6A and 6B show a state in which the bearing member is positioned with respect to the developing frame.
Figure 6A:
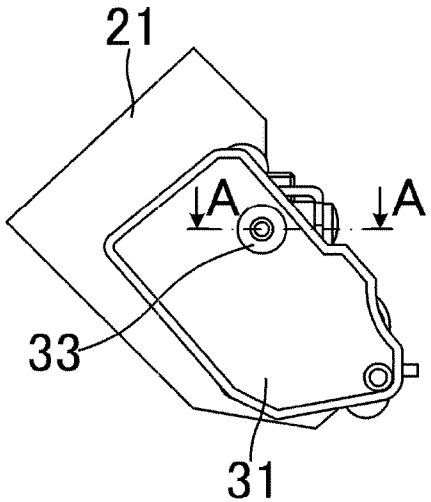

FIG. 5 is a perspective view showing a state before the bearing member 31 is attached to the developing frame 21. Further, FIGS. 6A and 6B are views showing a state in which the bearing member 31 is positioned with respect to the developing frame 21. More specifically, FIG. 6A is a side view of the developing unit D in a state in which the bearing member 31 is attached to the developing frame 21. FIG. 6B is a partial cross-sectional view of the developing unit D in a state in which the bearing member 31 is positioned with respect to the developing frame 21. Here, the bearing member 31 has a bearing portion 31*d* that rotatably supports the end portion of the rotation shaft of the developing roller 23, and a bearing portion 31*e* that rotatably supports the end portion of the rotation shaft of the supply roller 22. Further, the bearing member 31 is provided with a positioning portion 31*a* for positioning the bearing member 31 with respect to the developing frame 21, a positioning portion 31*b*, a positioning portion 31*c*, and an injection portion 33 for injecting a molten resin.

Here, a resin excellent in slidability (for example, a polyacetal resin or the like) is used as the material of the bearing member 31. Further, in the present example, a material which is incompatible with the material of the bearing member 31 is selected as the molten resin to be injected into the injection portion 33. As shown in FIGS. 6A and 6B, the injection portion 33 provided in the bearing member 31 has an injection port 33*a*, a resin flow path portion 33*b*, a step portion 35 for reducing the inner diameter of the resin flow path portion 33*b*, and an injection nozzle portion 34 (see FIG. 6B).

In this example, the entire path from the injection port 33*a* to the injection nozzle portion 34 is the flow path of the molten resin. In addition, the path from the injection port 33*a* to the injection nozzle portion 34 passes through the bearing member 31 and communicates with the joint portion 32 which is a recessed portion provided in the developing frame 21. A space filled with the molten resin is formed by this flow path (from the injection port 33*a* to the injection nozzle portion 34), the joint portion 32, and the screw tip 51 of the screw 50 projecting into the joint portion 32. Incidentally, the developing frame 21 and the bearing member 31 are assembled by engaging the positioning portions 31*a* to 31*c* (see FIG. 5) of the bearing member 31 with the positioning portions 21*a* to 21*c* (see FIG. 3) of the developing frame 21.

<Method of Joining the Bearing Member 31 to the Developing Frame 21>

Figure 7:
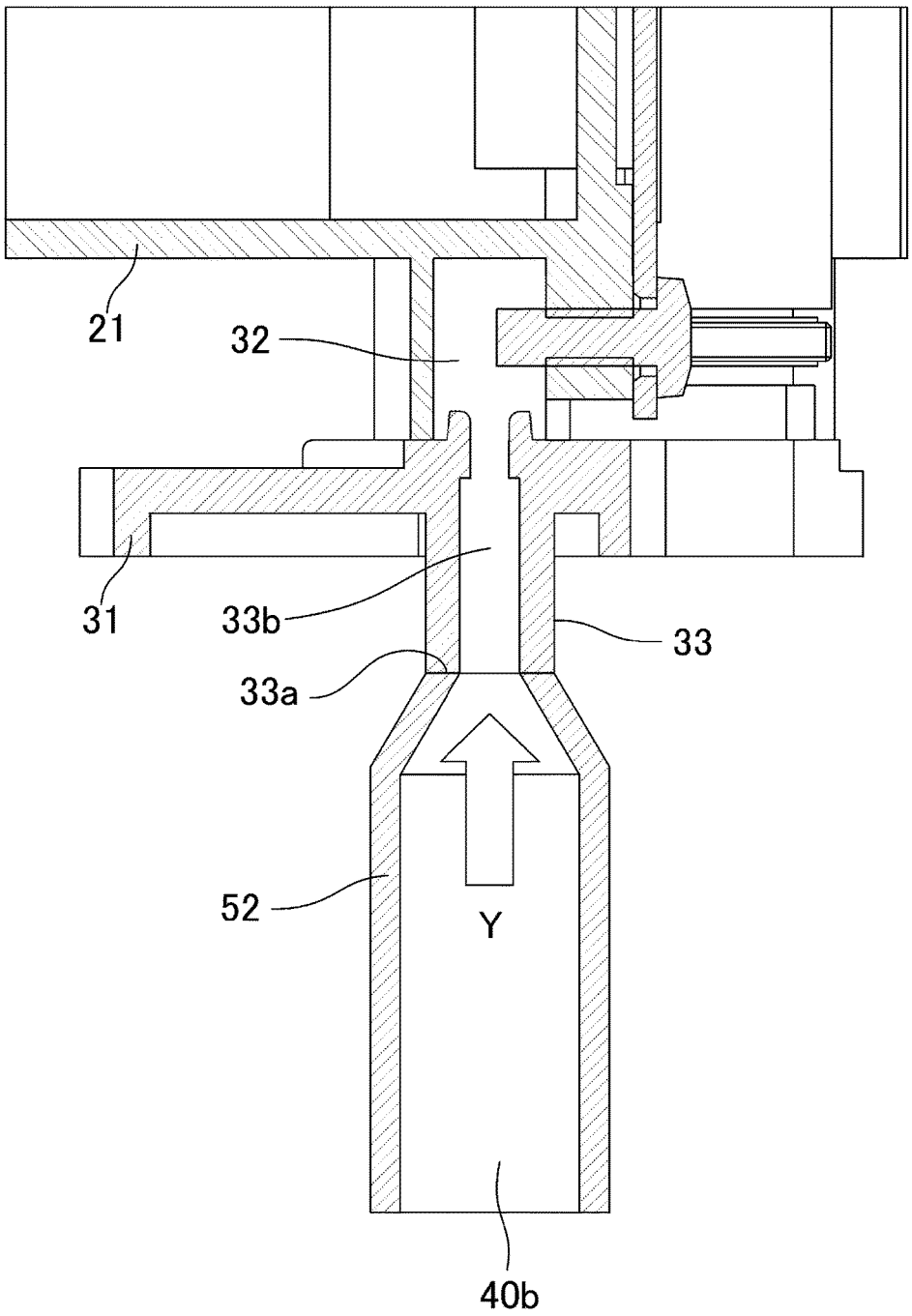
FIG. 7 is a cross-sectional view showing how the conductive molten resin is injected into the joint portion.
Figure 8:
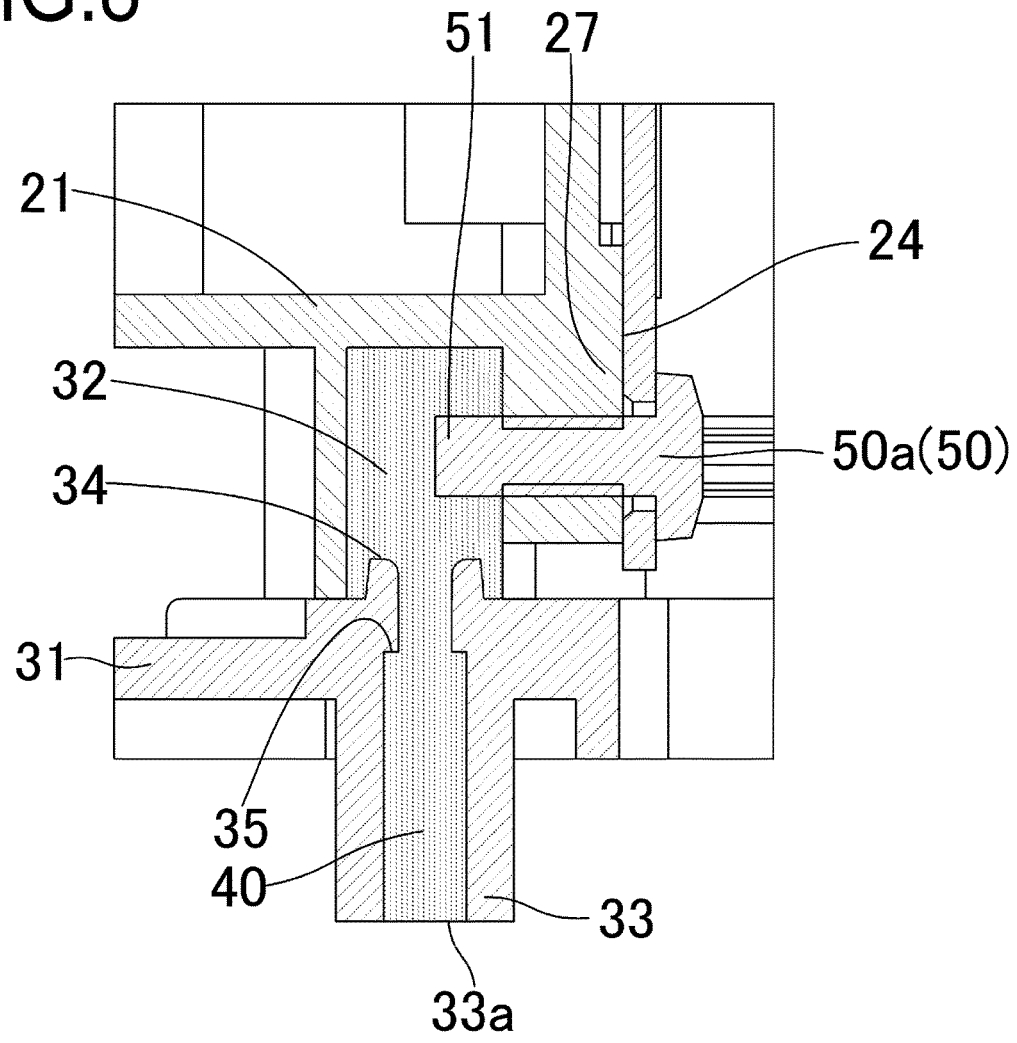
FIG. 8 is a cross-sectional view of the vicinity of the resin molded portion after the molten resin has solidified.

FIG. 7 is a cross-sectional view showing how the molten conductive resin is injected into the joint portion 32. Further, FIG. 8 is a cross-sectional view of the vicinity of the resin molded portion 40 after the molten resin has solidified. When the molten conductive resin is injected into the joint portion 32, a nozzle tip 52 of a resin injection device (not shown in the figure) for injecting the molten resin is brought into contact with the injection port 33*a* of the injection portion 33. An appropriate amount of the molten conductive resin is injected into the space of the joint portion 32 of the developing frame 21 through the resin flow path portion 33*b* of the bearing member 31. The molten resin flows in the direction of an arrow Y. The injected conductive resin solidifies (cures) immediately after the injection to become a resin molded portion 40 (resin member) (FIG. 8). The operation of joining the developing frame 21 and the bearing member 31 is thus completed.

Further, as shown in FIG. 8, the resin molded portion 40 is joined to the screw 50 as a result of cooling and solidification of the resin around the screw tip 51 of the screw 50 at the joint portion 32 in the developing frame 21. As a result, the resin molded portion 40 is fixed to the developing frame 21. This is because the screw tip 51 functions as a stopper for preventing the resin molded portion 40 from coming off. Further, the resin molded portion 40 is also fixed to the developing frame 21 because the screws 50 are fastened to the developing frame 21. Meanwhile, the resin molded portion 40 is formed into a shape having a step corresponding to the step portion 35 of the bearing member 31. The step shape in the resin molded portion 40 is engaged with the step portion 35 of the bearing member 31, thereby preventing the resin molded portion 40 from coming out of the bearing member 31 in a direction opposite to the direction in which the bearing member 31 is assembled with the developing frame 21.

In the present example, as described above, in the space filled with the molten resin material, the width (the inner diameter of the hole in the vicinity of the step portion 35) of the portion communicating the injection port 33*a* with the joint portion 32 is less than the width (inner diameter) of the injection port 33*a* and the width (inner diameter) of the joint portion 32. As a result, the resin molded portion 40 is fixed to the developing frame 21, and the resin molded portion 40 is not detached from the bearing member 31. Further, as described hereinabove, the resin molded portion 40 is fixed to the developing device frame 21 by screws 50. Therefore, the developing frame 21 and the bearing member 31 are joined together.

The resin molded portion 40 shrinks slightly when it is cooled and solidified. Because of this property, the resin around the screw 50 pushes the screw 50 after the resin molded portion 40 has solidified. Further, after the resin molded portion 40 has solidified, the resin around the step portion 35 and the injection nozzle portion 34 pushes the step portion 35 and the injection nozzle portion 34 in the direction of bringing the step portion 35 and the injection nozzle portion 34 closer to each other. As a result, the resin molded portion 40 is firmly fixed to the bearing member 31. Further, a force acts on the developing frame 21 in the direction of bringing the bearing member 31 and the developing frame 21 closer to each other. Therefore, the bearing member 31 is in a state of pushing the developing frame 21, thereby increasing close contact between the bearing member 31 and the developing frame 21. In particular, in the space filled with the molten resin, since the screws 50 protrude in a direction crossing (orthogonal to) the direction in which the resin molded portion 40 comes out from the joint portion 32, the bearing member 31 and the developing frame 21 are fixed more firmly.

<Reproduction method for the Development Unit D>

Next, a reproduction method (reusing method) for the developing unit D according to the present example will be described.

In the present example, a reproduction method for the developing unit D includes the following steps:

(1) a step of detaching the screws 50 from the developing frame 21 and the resin molded portion 40;

(2) a step of detaching the bearing member 31 from the developing frame 21;

(3) a step of detaching the developing roller 23 from the developing frame 21;

(4) a step of detaching the developing blade 24 from the developing frame 21;

(5) a step of attaching the bearing member 31 to the developing frame 21;

(6) a step of attaching the developing blade 24 to the developing frame 21;

(7) a step of fastening the screws 50 to the developing frame 21 and the resin molded portion 40;

(8) a step of attaching the developing roller 23 to the developing frame 21; and (9) a step of attaching the bearing member 39 to the developing frame 21.

<(1) Step of Detaching the Screw 50 from the Developing Frame 21 and the Resin Molded Portion 40>

Figure 9:
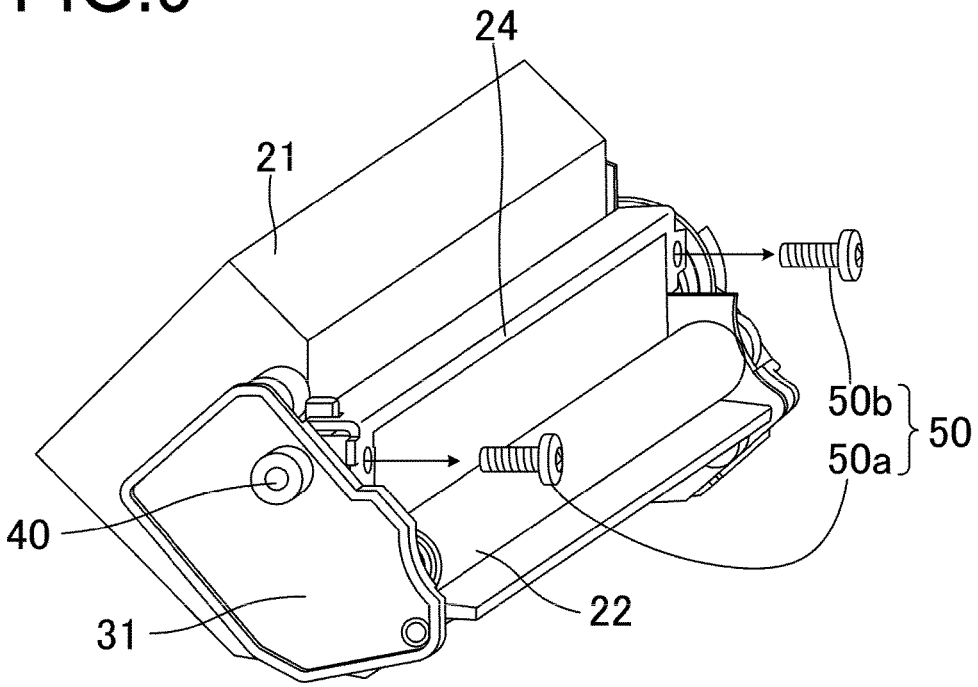
FIG. 9 is a perspective view showing how the screw is detached from the developing frame according to Example 1.
Figure 10:
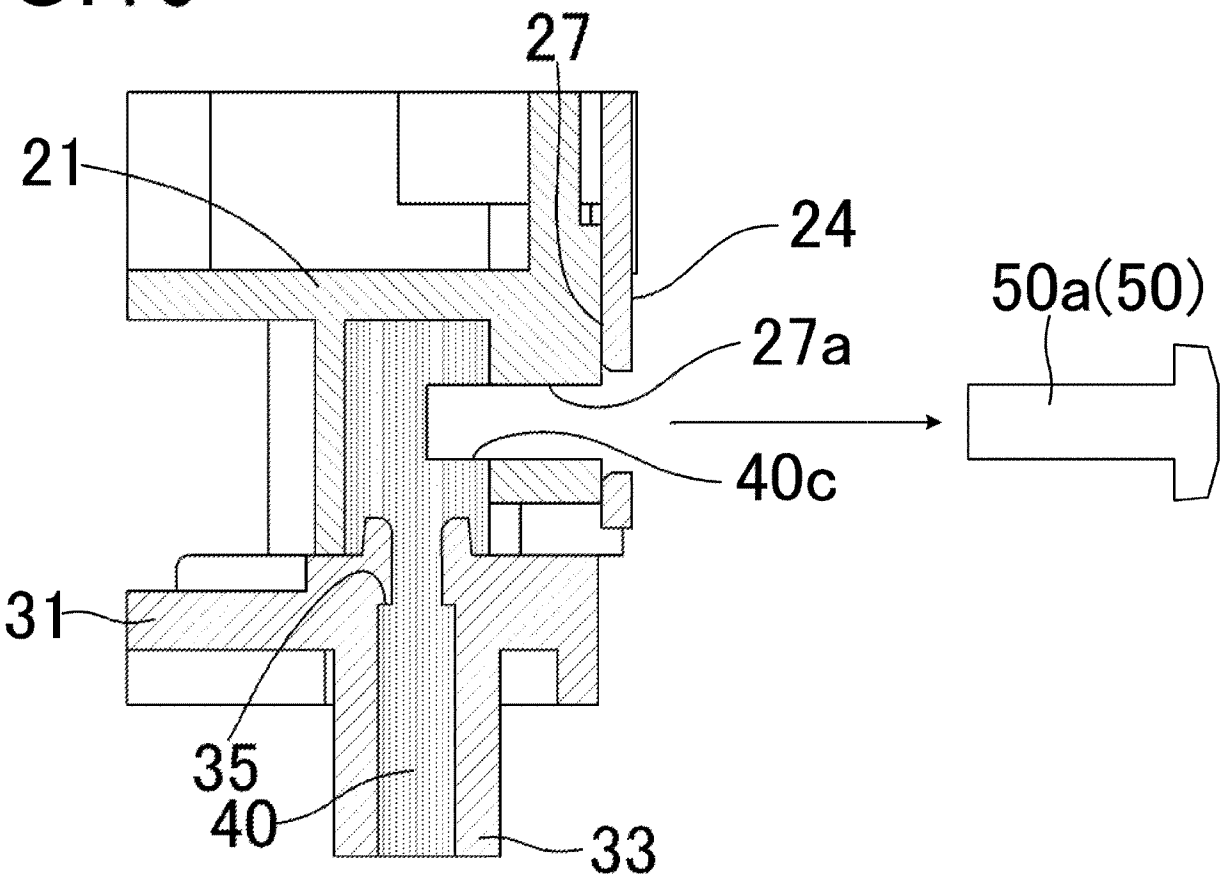
FIG. 10 is a cross-sectional view showing how the screw is detached from the developing frame according to Example 1.

A step of detaching (releasing the engagement (screwing) of) the screws 50 from the developing frame 21 and the resin molded portion 40 will be described hereinbelow with reference to FIGS. 9 and 10. FIG. 9 is a perspective view showing how the screws 50 (screw 50*a*, screw 50*b*) are detached from the developing frame 21. Further, FIG. 10 is a cross-sectional view showing how the screw 50*a* is detached from the developing frame 21.

In this step, as shown in FIG. 9, the two screws 50 (screw 50*a*, screw 50*b*) fixing the developing blade 24 to the developing frame 21 are detached from the developing frame 21. The screw 50*a* is provided at a position close to the bearing member 31, and in this step, the screw 50*a* is detached from the developing frame 21 and the resin molding portion 40. At this time, as shown in FIG. 10, in the resin molded portion 40, a recessed portion 40*c* serving as a screw hole engaged with the screw 50*a* is exposed. Further, in this step, the developing blade 24 is not yet detached from the developing frame 21 at this point of time.

<(2) Step of Detaching the Bearing Member 31 from the Developing Frame 21>

Figure 11:
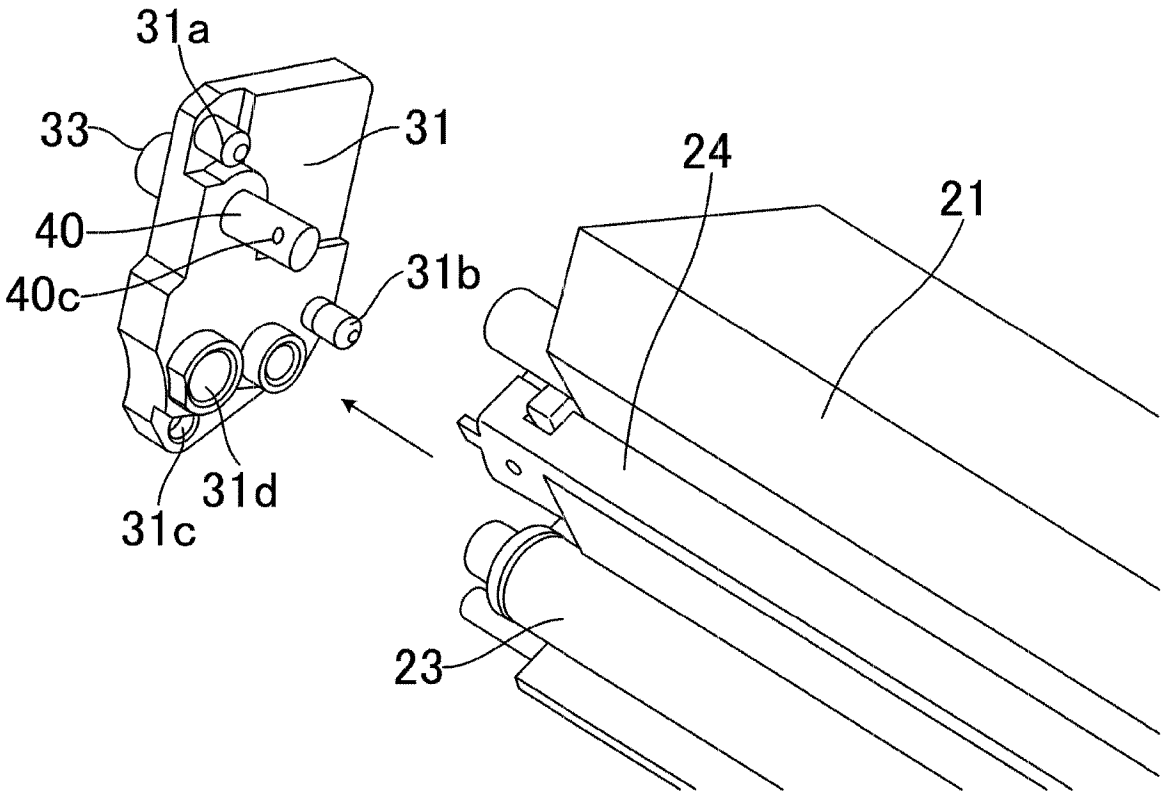
FIG. 11 is a perspective view showing a state in which the bearing member is detached from the developing frame according to Example 1.
Figure 12:
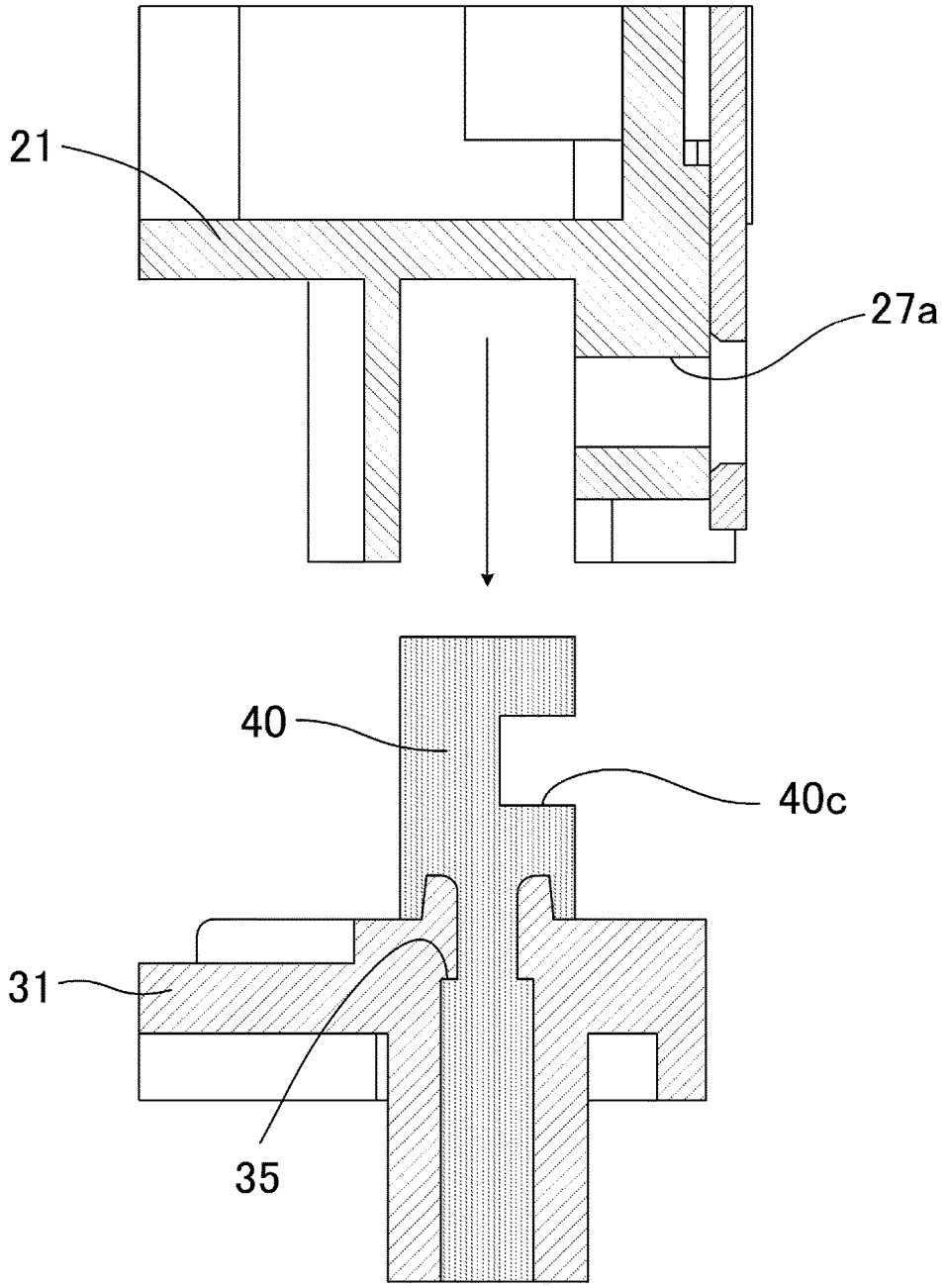
FIG. 12 is a cross-sectional view showing how the bearing member is detached from the developing frame according to Example 1.

The step of detaching the bearing member 31 from the developing frame 21 will be described hereinbelow with reference to FIGS. 11 and 12. FIG. 11 is a perspective view showing how the bearing member 31 is detached from the developing frame 21. Further, FIG. 12 is a cross-sectional view showing how the bearing member 31 is detached from the developing frame 21. Since the resin molded portion 40 has been fixed to the bearing member 31, in this step, the bearing member 31 and the resin molded portion 40 are integrally detached from the developing frame 21. In the configuration of the present example, the resin molded portion 40 is detached from the developing frame 21, but the resin molded portion 40 is not detached from the bearing member 31, so that the bearing member 31 and the resin molded portion 40 could be integrally detached from the developing frame 21.

Further, as shown in FIG. 8, in a state in which the screws 50 are engaged with the resin molded portion 40, the screw tip 51 of the screw 50 has a stopper function preventing the joint portion 32 of the developing device frame 21 from coming out of the resin molded portion 40. With such a configuration, in a state where the screws 50 are engaged with the resin molded portion 40, the bearing member 31 is not detached from the developing frame 21. However, since the screw 50*a* is detached in the above-described step (1) (the step of detaching the screws 50), there is no stopper for preventing the resin molded portion 40 from coming out of the joint portion 32 in this state. Furthermore, as described hereinabove, in this assembly, the material of the resin molded portion 40 and the material of the developing frame 21 are not mutually compatible. For the reasons described hereinabove, the resin molded portion 40 is detached from the joint portion 32 in the developing frame 21. Meanwhile, the resin molded portion 40 is not detached from the bearing member 31 because the step portion 35 is provided. Therefore, it is possible to detach the bearing member 31 and the resin molded portion 40 integrally from the developing frame 21.

Meanwhile, as shown in FIGS. 2A and 2B, the bearing member 39 provided on the opposite side of the bearing member 31 and rotatably supporting the developing roller 23 is fixed to the developing frame 21 by screws or the like. Therefore, the bearing member 39 is detached from the developing frame 21 by removing the screws or the like. It is to be noted that the "step of detaching the bearing member 39" may be performed at any time as long as it is before "(3) a step of detaching the developing roller 23 from the developing frame 21".

<(3) Step of Detaching the Developing Roller 23 from the Developing Frame 21>

Figure 13:
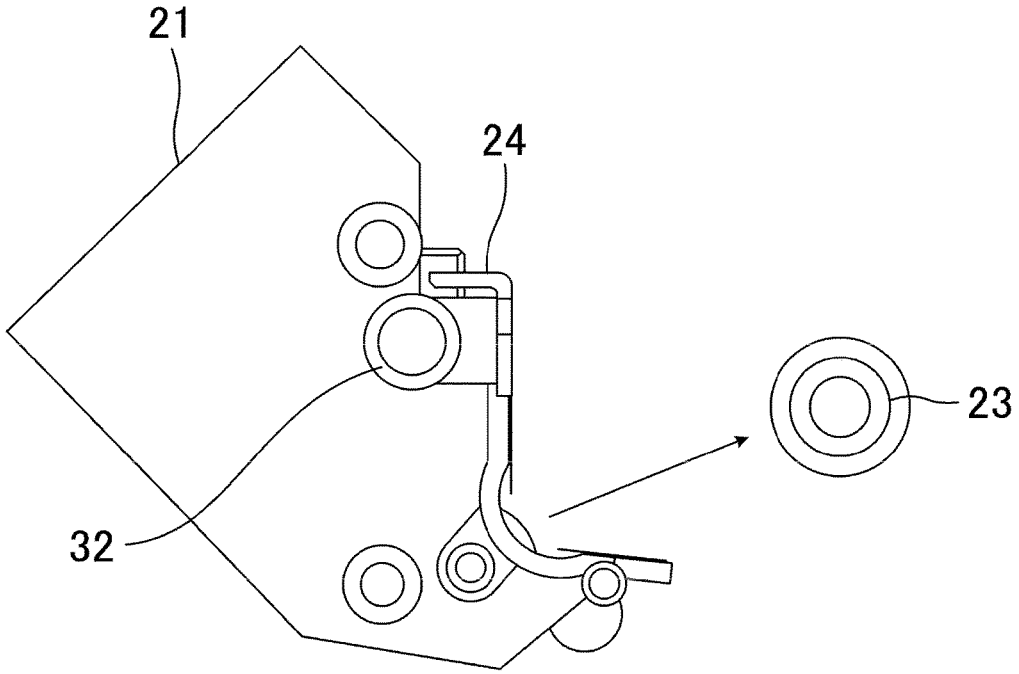
FIG. 13 is a side view showing how the developing roller according to Example 1 is detached from the developing frame.

FIG. 13 is a side view showing how the developing roller 23 according to Example 1 is detached from the developing frame 21. As shown in FIG. 13, in this step, the developing roller 23 is detached from the developing frame 21. The developing roller 23 can be detached from the developing frame 21 because the bearing member 31 and the bearing member 39 that support both ends of the rotation shaft of the developing roller 23 have been detached in the preceding steps.

<(4) Step of Detaching the Developing Blade 24 from the Developing Frame 21>

Figure 14:
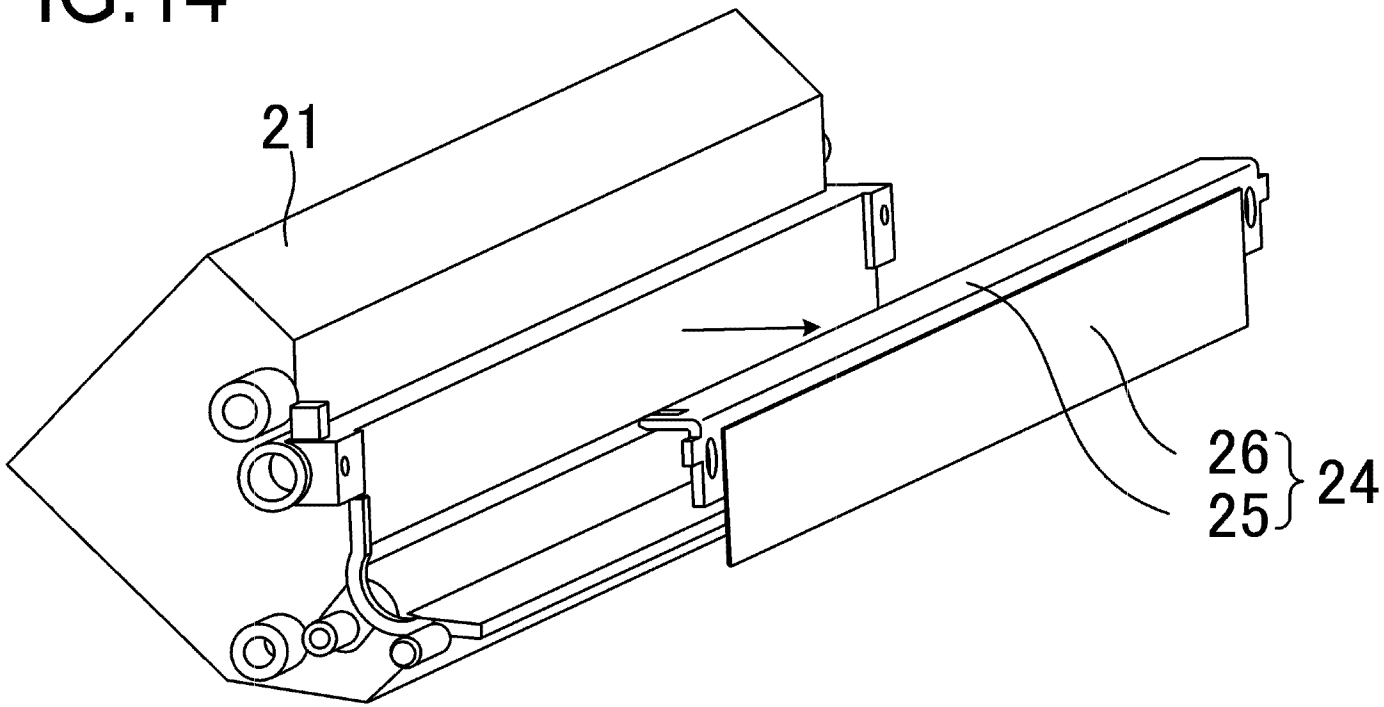
FIG. 14 is a perspective view showing a state in which the developing blade is detached from the developing frame according to Example 1.

FIG. 14 is a perspective view showing how the developing blade 24 according to Example 1 is detached from the developing frame 21. As shown in FIG. 14, in this step, the developing blade 24 is detached from the developing frame 21. The developing blade 24 can be detached from the developing frame 21 because the screws 50 for fixing the developing blade 24 to the developing frame 21 have been detached in the previous step.

<(5) Step of Attaching the Bearing Member 31 to the Developing Frame 21>

Figure 15A:
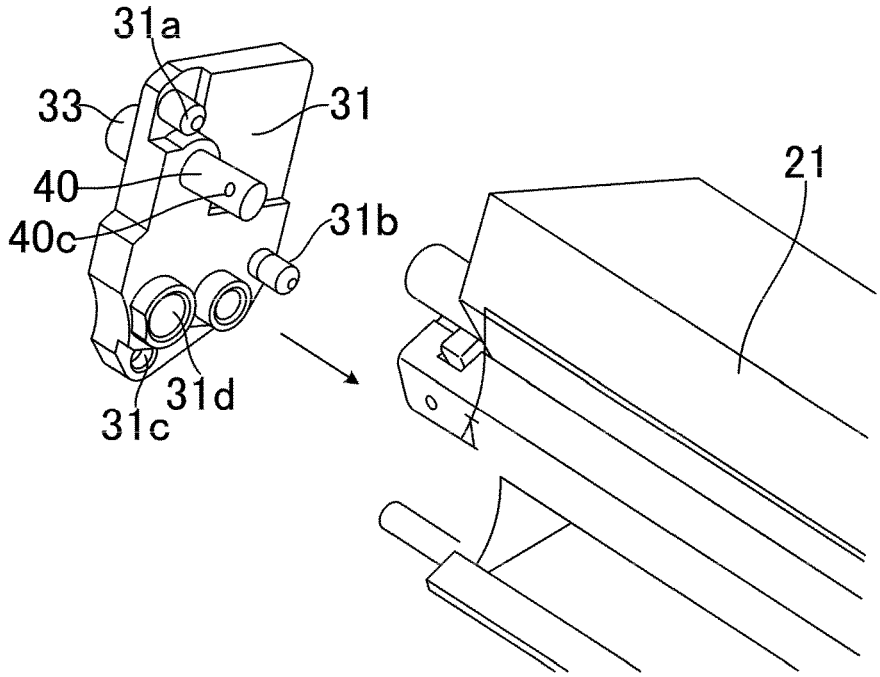
FIGS. 15A and 15B are perspective views showing how the bearing member according to Example 1 is attached to the developing frame.
Figure 16:
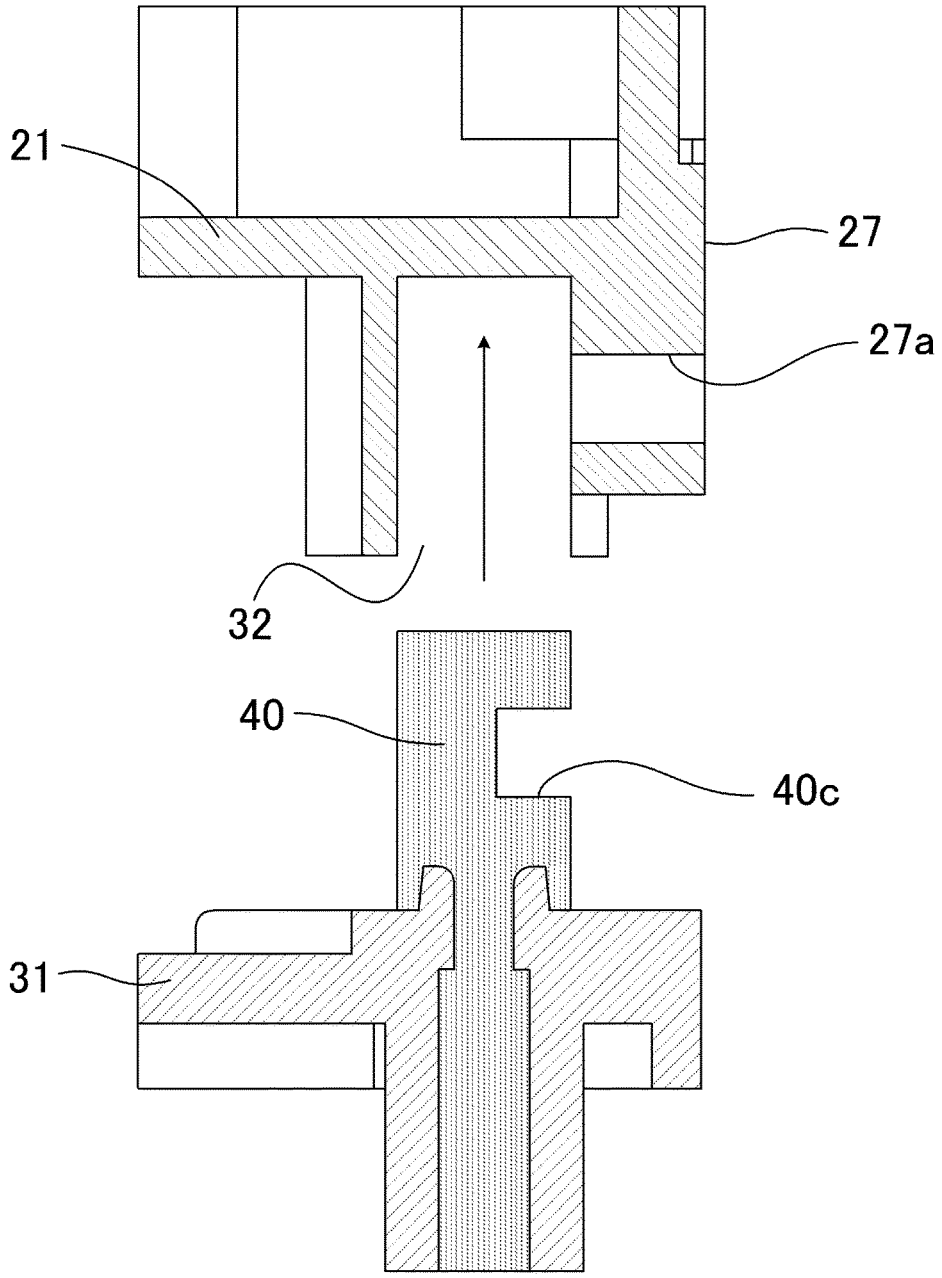
FIG. 16 is a cross-sectional view showing how the bearing member according to Example 1 is attached to the developing frame.

FIG. 15A is a perspective view showing how the bearing member 31 according to Example 1 is attached to the developing frame 21. Further, FIG. 16 is a cross-sectional view showing how the bearing member 31 according to Example 1 is attached to the developing frame 21. In this step, the resin molded portion 40 and the bearing member 31 which have been integrally detached in the previous steps are reattached to the developing frame 21.

Figure 15B:
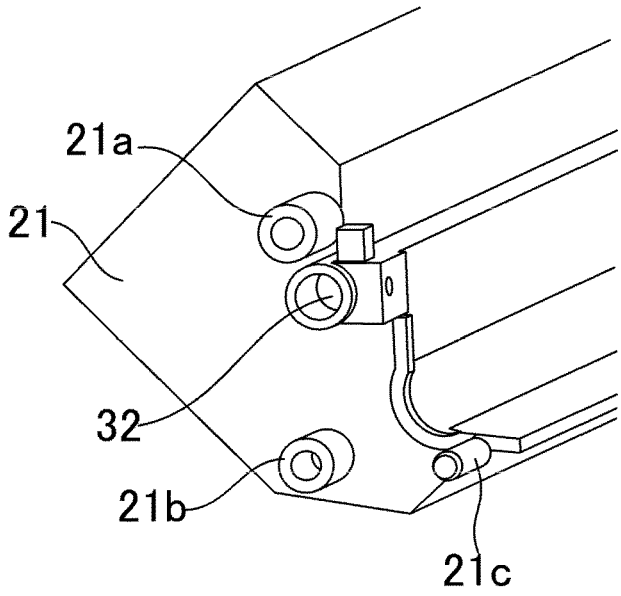

It should be noted that the resin molded portion 40 and the bearing member 31, which have been integrally detached, are not necessarily attached to the developing frame 21 to which they have been originally attached. For example, the resin molded portion 40 and the bearing member 31, which have been integrally detached, may be attached to another developing frame 21 of the same type. Specifically, as shown in FIGS. 15 and 16, the resin molded portion 40 is inserted into the joint portion 32, the positioning portions 31*a* to 31*c* (see FIG. 15A) are engaged with the positioning portions 21*a* to 21*c*, respectively (see FIG. 15B), and the bearing member 31 is connected to the developing frame 21.

<(6) Step of Adjusting the Position of the Developing Blade 24 with Respect to the Developing Frame 21>

In this step, the position of the developing blade 24 with respect to the developing frame 21 is adjusted. More specifically, the position of the developing blade 24 with respect to the developing frame 21 is adjusted so that the developing blade 24 can be attached to the developing frame 21 by using the screws 50.

<(7) Step of Fixing the Developing Blade 24 to the Developing Frame 21>

Figure 17:
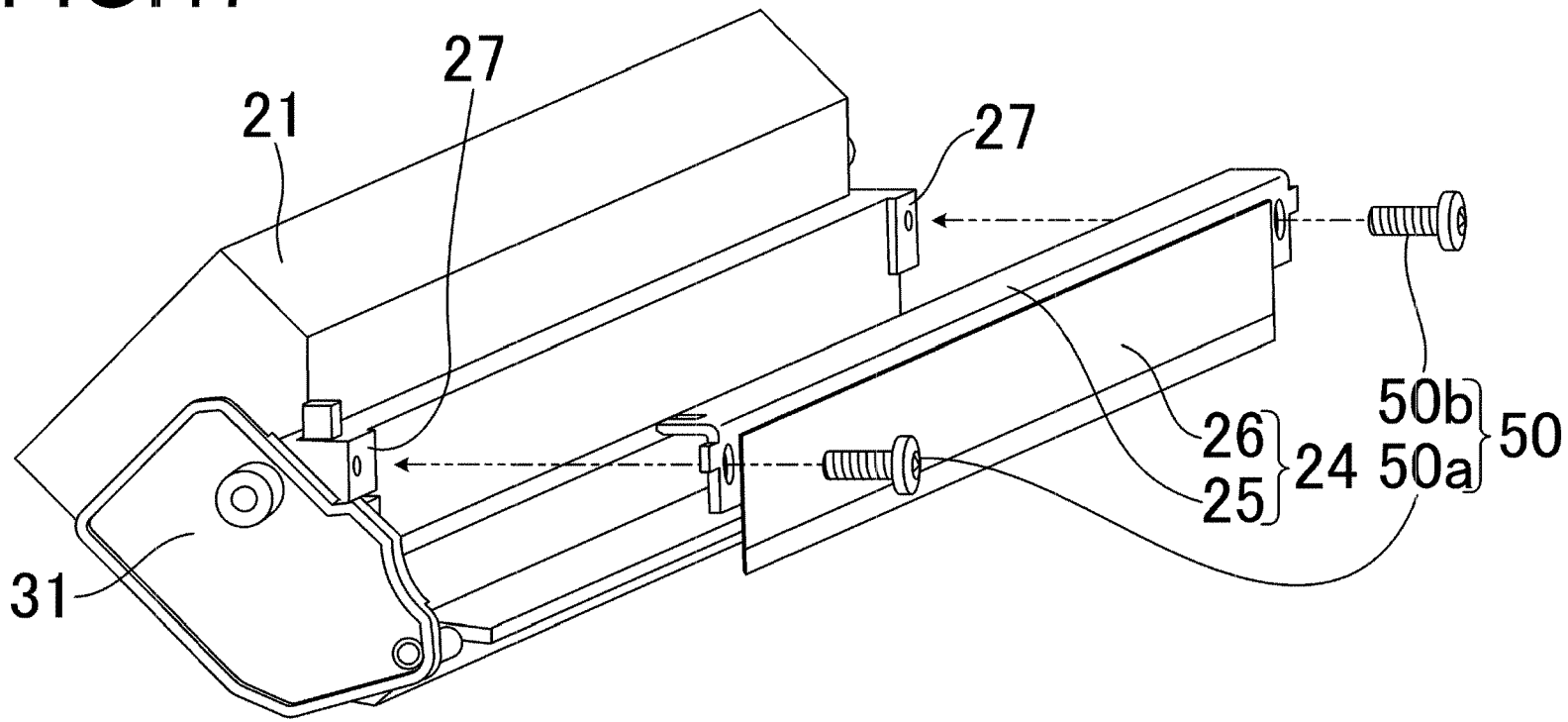
FIG. 17 is a perspective view showing how the developing blade according to Example 1 is attached to the developing frame.

FIG. 17 is a perspective view showing how the developing blade 24 according to Example 1 is positioned with respect to the developing frame 21. In this step, the developing blade 24 is attached to the developing frame 21 by using the screws 50. First, as shown in FIG. 17, the developing blade 24 is brought into contact with two seating surfaces 27 provided at the developing frame 21. Next, the developing blade 24 is fixed to the developing frame 21 by using two screws 50 (screw 50*a*, screw 50*b*). More specifically, each screw 50 is passed through the hole provided in the developing blade 24, and the screws 50 are engaged with the resin molded portion 40, thereby fixing the developing blade 24 to the developing frame 21.

Specifically, as a result of inserting (threading) the screws 50 into a recessed portion 40*c* of the resin molded portion 40, the threaded portion of the screw 50*a* engages with the resin molded portion 40 and the screws 50 are fixed with respect to the resin molded portion 40. As a consequence, since the resin molded portion 40 and the screws 50 are electrically connected, electric power is supplied from a power supply member (not shown in the figure) to the metal support sheet 25 through the resin molded portion 40. When the developing blade 24 is attached to the developing frame 21 with high accuracy, the developing blade 24 is provisionally fastened by the two screws 50 (the screw 50*a* and the screw 50*b*), and the developing blade 24 may be fixed to the developing frame 21 while measuring the position of the tip of the developing blade 24.

<(8) Step of Attaching the Developing Roller 23 to the Developing Frame 21>

Figure 18:
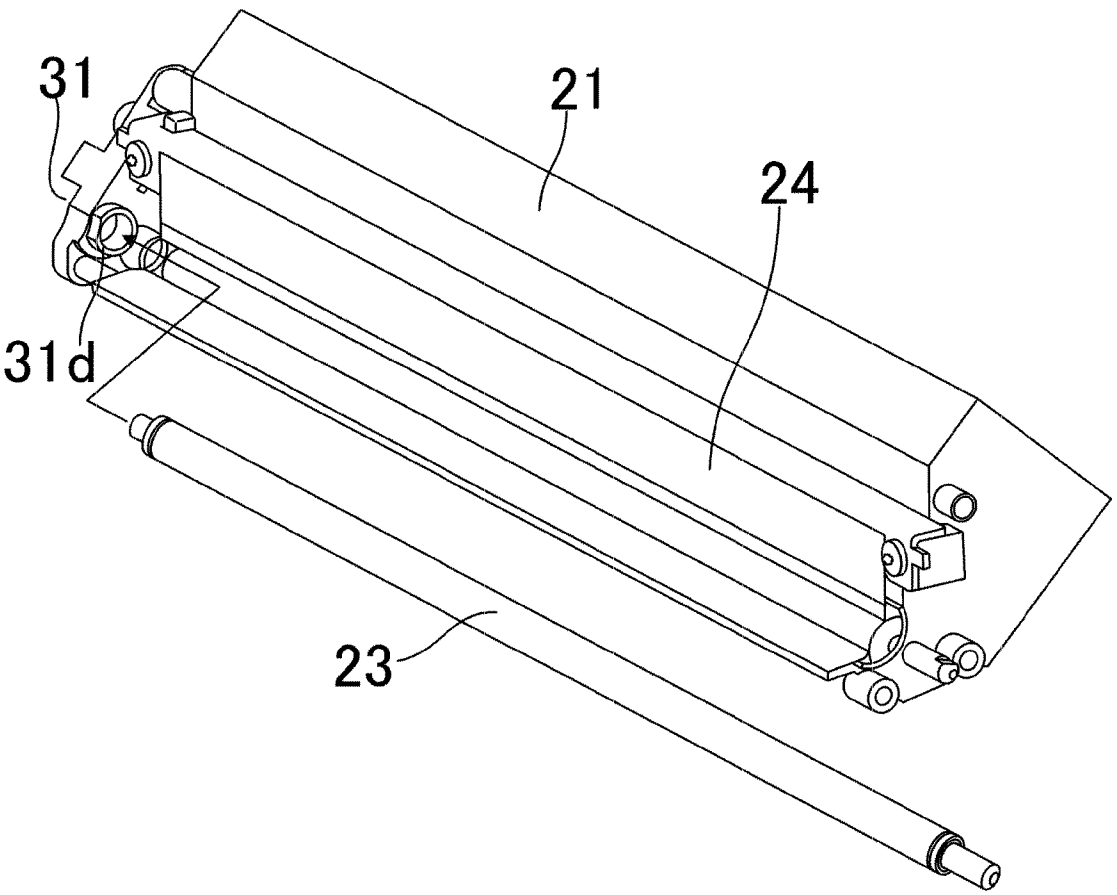
FIG. 18 is a perspective view showing how the developing roller according to Example 1 is attached to the developing frame.

FIG. 18 is a perspective view showing how the developing roller 23 is attached to the developing frame 21. In the step (5), the bearing member 31 has already been attached to the developing frame 21, and the rotating shaft of the developing roller 23 is engaged with the bearing portion 31*d* of the bearing member 31.

<(9) Step of Attaching the Bearing Member 39 to the Developing Frame 21>

Figure 19:
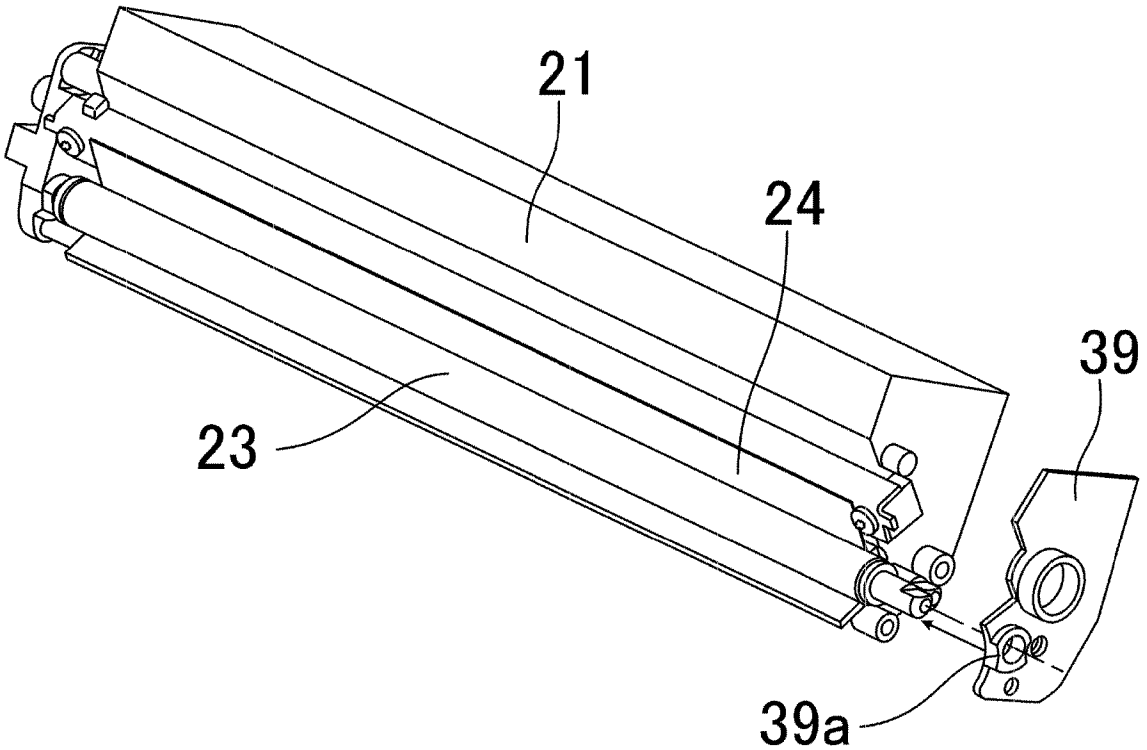
FIG. 19 is a perspective view showing how the bearing member according to Example 1 is attached to the developing frame.

The step of attaching the bearing member 39 to the developing frame 21 will be described hereinbelow with reference to FIGS. 2 and 19. FIG. 19 is a perspective view showing how the bearing member 39 is attached to the developing frame 21. In this step, the rotating shaft of the developing roller 23 is engaged with a developing roller support portion 39*a* of the bearing member 39, and the bearing member 39 is fastened to the developing frame 21 by a screw or the like (not shown in the figure). After assembling the bearing member 39 with the developing frame 21, as shown in FIGS. 2A and 2B, a side cover 37 for covering a driving gear 38 and the like is reattached to the developing frame 21, thereby completing the reproduction of the developing unit D.

In the case of refilling the developing frame 21 with the developer, the order of the step of refilling the developing frame 21 with the developer is not particularly restricted. For example, the step of refilling the developing frame 21 with the developer may be performed after the step (4) (the step of detaching the developing blade 24 from the developing frame 21). Further, for example, the step of refilling the developing frame 21 with the developer may be also performed after the step (9) (the step of attaching the bearing member 39 to the developing frame 21).

In this example, the step (2) (the step of detaching the bearing member 31 from the developing frame 21) is performed after the step (1) (the step of detaching the screw 50 from the developing frame 21 and the resin molded portion 40). Therefore, it is possible to detach the bearing member 31 from the developing frame 21 without fracturing the resin molded portion 40. However, as described above, the screw 50*a* has a function of a stopper for preventing the bearing member 31 and the developing frame 21 from coming apart. Therefore, where the step (2) is performed before the step (1), although the resin molded portion 40 is fixed by the screw 50*a*, since the resin molded portion 40 comes apart from the developing frame 21, the resin molded portion 40 is fractured.

As described above, in the present example, it is possible to reproduce the developing unit D and the process cartridge B without using any new parts and without fracturing the resin molded portion 40.

Example 2

Next, Example 2 will be described with reference to FIGS. 8 and 20. Here, in the present example, parts having the same functions as those of Example 1 are denoted by the same reference numerals, and description thereof is herein omitted. In this example, the order of steps performed to reproduce the developing unit D is the same as in Example 1. As described above, in order to supply electric power to the metal support sheet 25 through the resin molded portion 40 and the screw 50*a*, the screw 50*a* and the resin molded portion 40 need to be electrically connected.

As shown in FIG. 8, when the developing unit D is newly assembled (not reproduced), the resin molded portion 40 undergoes thermal shrinkage, so that the screw 50*a* is brought into close contact with the resin molded portion 40, thereby electrically connecting the screw 50*a* and the resin molded portion 40 in a stable manner. However, where the developing unit D is reproduced, insertion and extraction of the screw 50*a* into and from the recessed portion 40*c* (corresponds to the inside of the screw hole) of the resin molded portion 40 is sometimes performed repeatedly. In this case, since the inner wall surface of the recessed portion 40*c* of the resin molded portion 40 is scratched, the electrical connection between the screw 50*a* and the resin molded portion 40 can become unstable as compared with the case where the developing unit D is a new unit.

Figure 20:
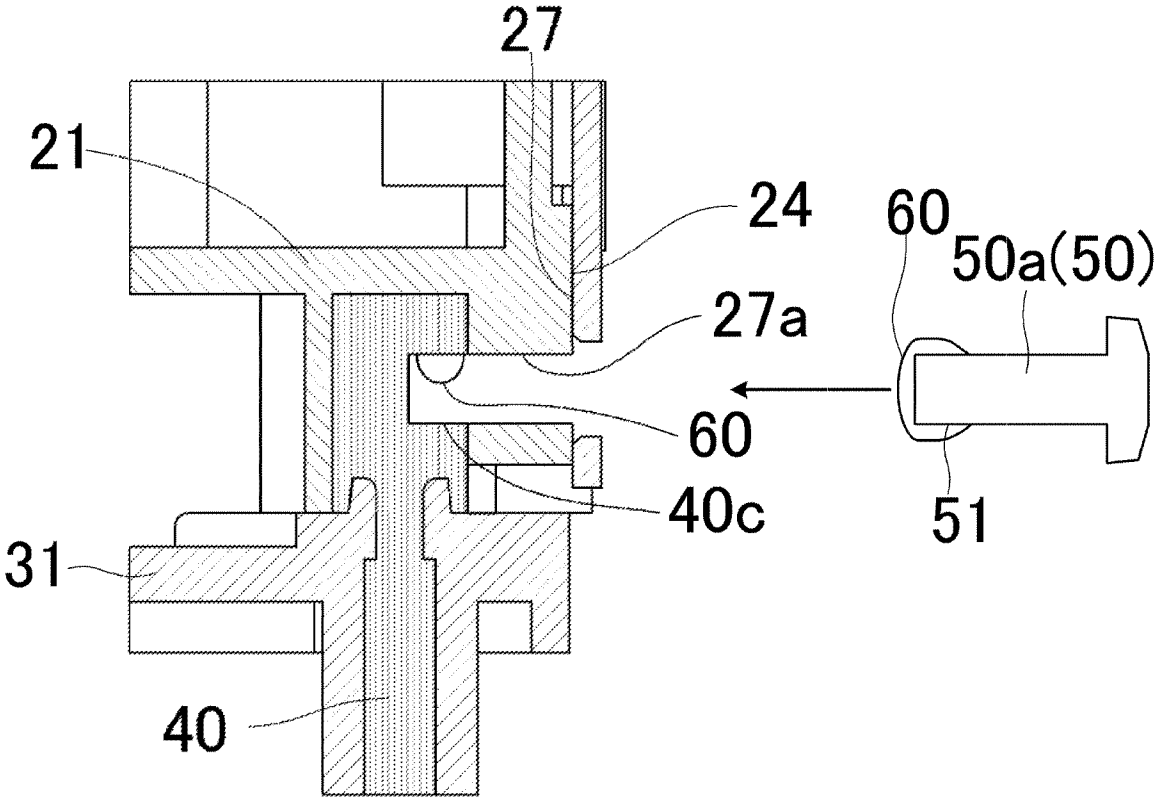
FIG. 20 is a view showing how the screw is fixed to the developing frame in Example 2.

Accordingly, in the present example, as shown in FIG. 20, a conductive grease 60 is applied to at least one of the screw tip 51 of the screw 50*a* and the recessed portion 40*c* of the resin molded portion 40, and the screw 50*a* is fastened to the screw hole 27*a* and the recessed portion 40*c* in the developing frame 21. Here, the conductive grease 60 has a viscosity and exemplifies a conductive member. Therefore, after the screw 50*a* has been engaged with the resin molded portion 40, the conductive grease 60 is interposed between the screw tip 51 and the resin molded portion 40. By coating the conductive grease 60 on the screw tip 51 or the like as described above, it is possible to connect electrically the screw 50*a* and the resin molded portion 40 in a stable manner even when the developing unit D is reproduced.

In this example, the conductive grease 60 is coated on the screw tip 51 or the like, but the present invention is not limited to such a configuration. Thus, a thin metal sheet such as an aluminum foil may be wound around the screw 50*a*. The configuration is not particularly limited as long as a deformable conductive member is interposed between the screw 50*a* and the resin molded portion 40.

As described above, in the present example, by coating the conductive grease 60 or the like on the screw 50*a*, the screw 50*a* and the resin molded portion 40 are electrically connected in a stable manner even when the developing unit D is reproduced.

Example 3

Figure 21:
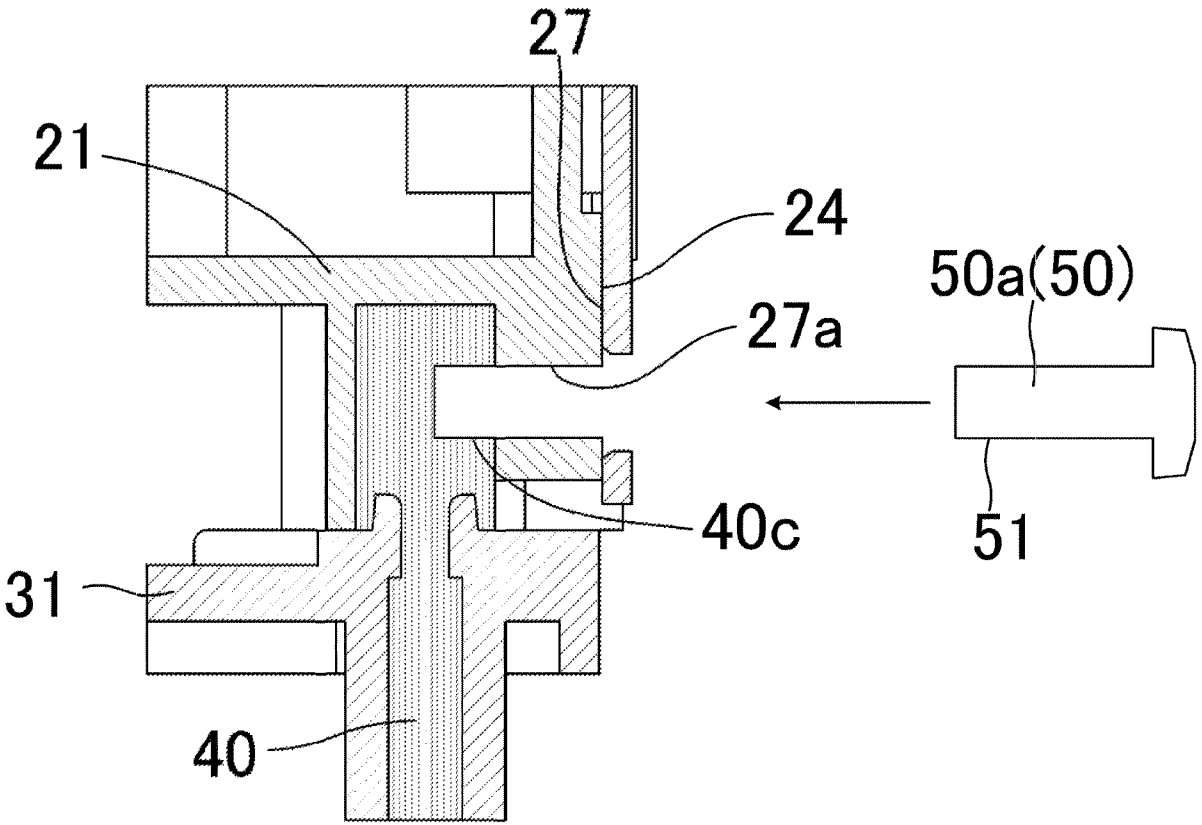
FIG. 21 is a view showing how the screw is fixed to the developing frame in Example 3.

Next, Example 3 will be described with reference to FIG. 21. FIG. 21 is a view showing how the screw 50*a* is fixed to the developing frame 21 in Example 3. In this example, the order of the steps performed to reproduce the developing unit D is the same as that of Example 1. In this example, the electrical connection between the screw 50*a* and the resin molded portion 40 can be improved by a method different from that of Example 2.

In the present example, when the detached screw 50*a* is again inserted into the resin molded portion 40, the screw 50*a* is heated, and the screw 50*a* is inserted so as to be brought into contact with the resin molded portion 40. In this case, as a result of inserting the screw 50*a* into the resin molded portion 40 after heating the screw 50*a*, the inner wall surface of the recessed portion 40*c* of the resin molded portion 40 melts and the molten resin comes into close contact with the screw tip 51 of the screw 50*a*. As a result, when the molten resin is thereafter solidified, the recessed portion 40*c* of the resin molded portion 40 and the screw 50*a* are brought into close contact with each other, so that the electrical connection between the screw 50*a* and the resin molded portion 40 can be improved.

As described above, in the present example, the screw 50*a* is inserted into the resin molded portion 40 after the screw 50*a* has been heated. As a result, the recessed portion 40*c* of the resin molded portion 40 and the screw 50*a* are brought into close contact with each other, and the electrical connection between the screw 50*a* and the resin molded portion 40 can be improved.

Example 4

In Example 4 and the below-described Example 5, before and after the replacement of parts of the developing unit D or the replenishment of the developing unit D with the developer, different screws are used as the first and second fixing members to be inserted into the screw hole 27*a* provided in the developing frame 21 and to be engaged with the resin molded portion 40.

Figure 22B:
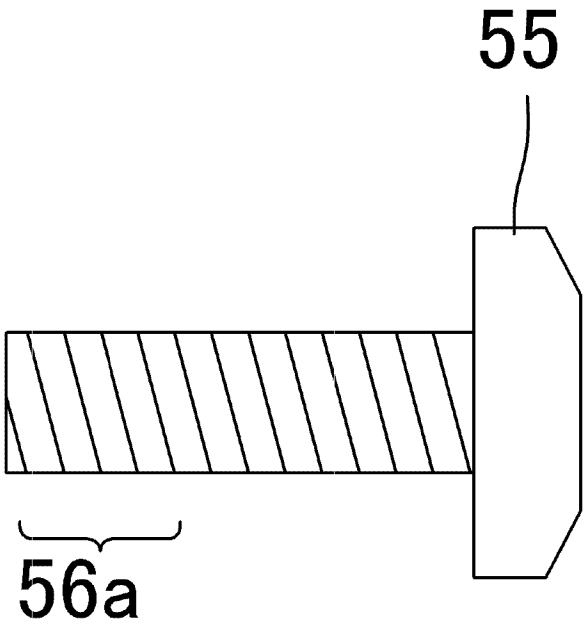
FIGS. 22A and 22B are views showing a screw for fixing the developing blade according to Example 4 to the developing frame.
Figure 22A:
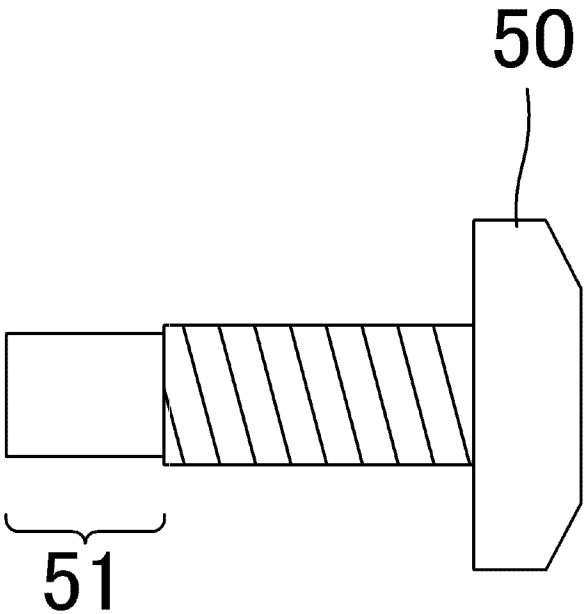

Here, the screws 50 (corresponds to the first fixing member and the first screw member) and screws 55 (corresponds to the second fixing member and the second screw member) according to the present example will be described with reference to FIGS. 22A and 22B. FIGS. 22A and 22B are side views of the screw 50 and the screw 55 for fixing the developing blade 24 to the developing frame 21. Specifically, FIG. 22A is a side view of the screw 50, and FIG. 22B is a side view of the screw 55. In this example, the screw tip 51, which is the distal end portion of the screw 50, has a cylindrical shape which is not threaded. Meanwhile, a screw tip 56*a*, which is the distal end portion of the screw 55 is a threaded screw portion. In the present example, the screw 50 is used when the developing unit D is manufactured, and the screw 55 is used when the developing unit D is reproduced. As a result, the developing blade 24 can be firmly fixed to the developing frame 21. Further, in this example, it is possible to stabilize the electrical connection state between the screw 55 and the resin molded portion 40.

Figure 23:
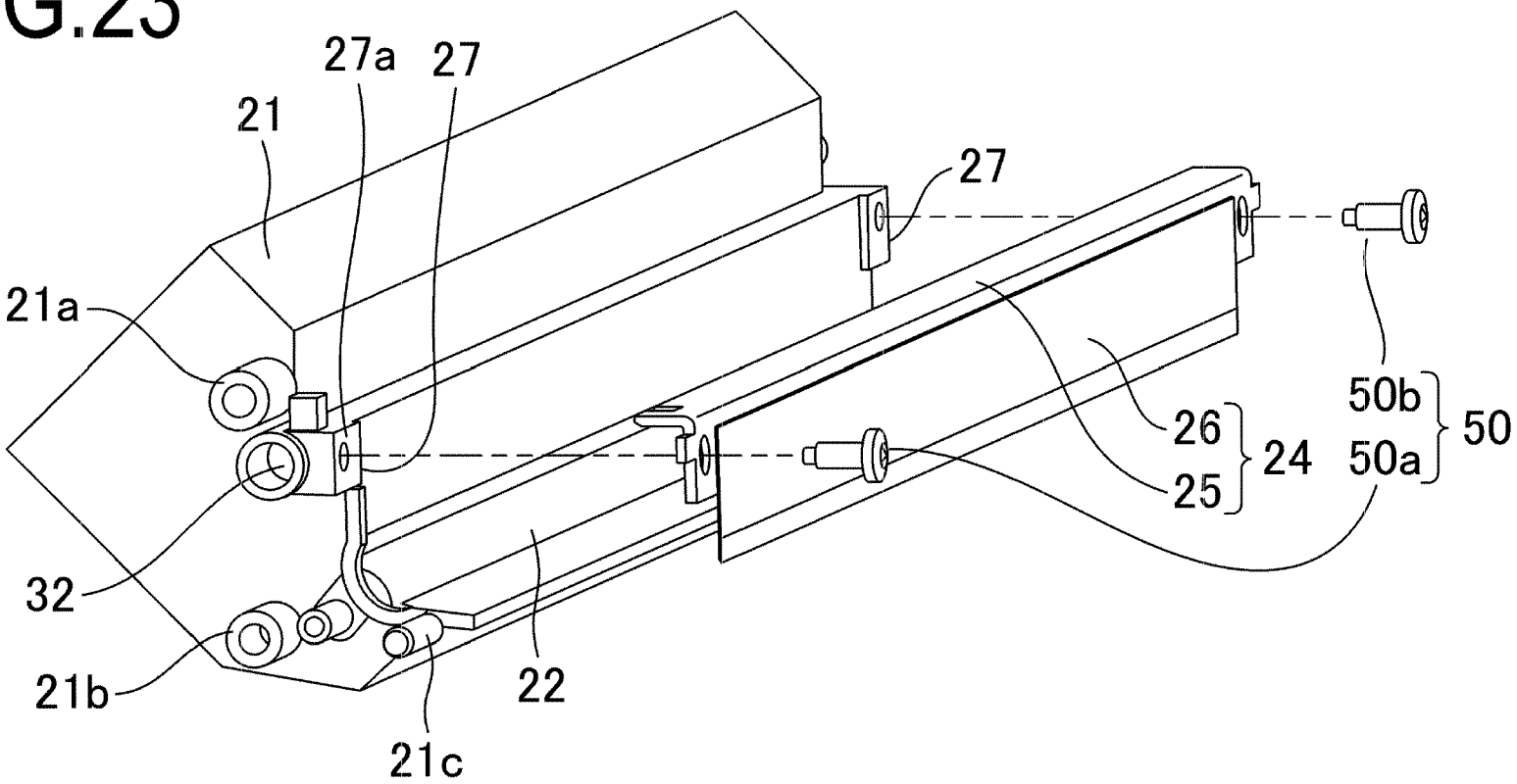
FIG. 23 is a perspective view showing how the developing blade is attached to the developing unit in Example 4.
Figure 24:
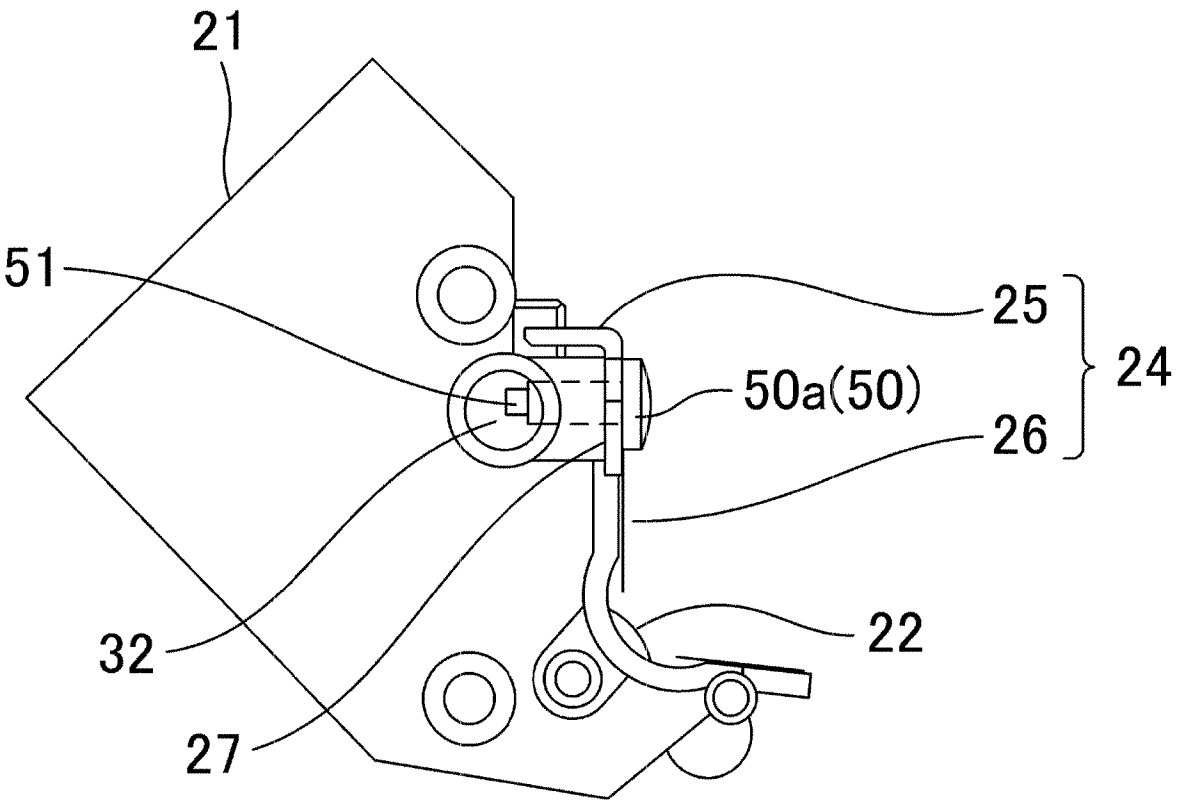
FIG. 24 is a side view showing a state in which a developing blade is attached to the developing frame in Example 4.
Figure 25B:
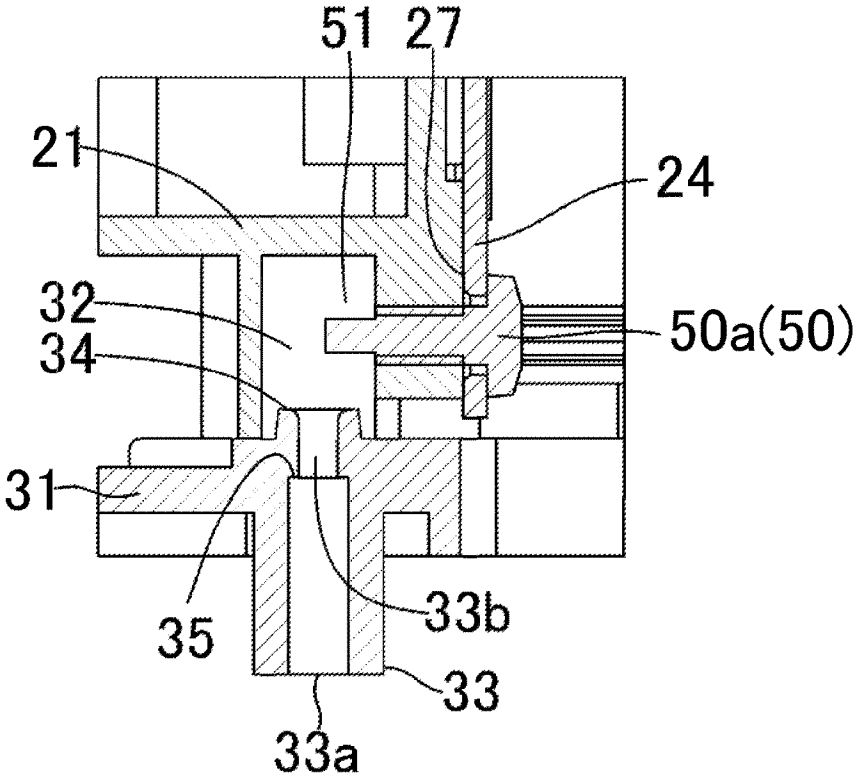
FIGS. 25A and 25B are views showing a state in which the bearing member is positioned with respect to the developing frame in Example 4.
Figure 25A:
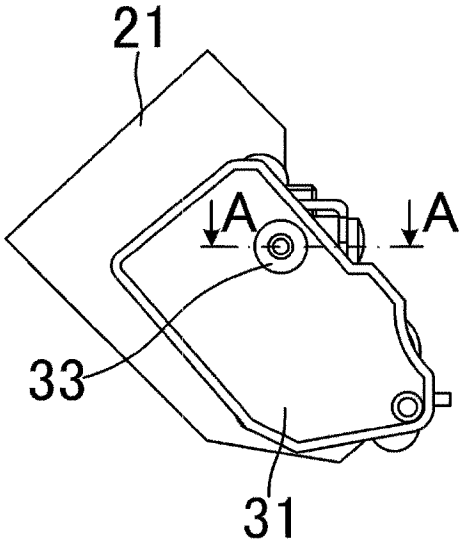

The steps performed when the developing unit D is manufactured are the same as those described in Example 1, except for the shape of the screw tip 51 which is the distal end portion of the screw 50, and the explanation these steps is herein omitted. However, since the screw 50 in this example has the screw tip 51 which is threadless, a perspective view showing how the developing blade 24 is attached to the developing unit D is as shown in FIG. 23. Further, a side view showing a state in which the developing blade 24 is attached to the developing frame 21 is as shown in FIG. 24. FIGS. 25A and 25B show a state in which the bearing member 31 is positioned with respect to the developing frame 21. Specifically, FIG. 25A is a side view of the developing unit D in a state where the bearing member 31 is attached to the developing frame 21. FIG. 25B is a partial cross-sectional view of the developing unit D in a state in which the bearing member 31 is positioned with respect to the developing frame 21.

<Reproduction method for the Development Unit D>

The reproduction method for the developing unit D in this example has the following steps. Thus, the screw 50 which is used for manufacturing the developing unit D and detached in the step (1) and the screw 55 which is used for reproducing the developing unit D and fastened in the step (7) are different. Except for this feature, the reproduction method for the developing unit D in this example is the same as in Example 1. Accordingly, detailed explanation of the same steps as those in Example 1 is herein omitted.

(1) A step of detaching the screw 50 from the developing frame 21 and the resin molded portion 40;

(2) a step of detaching the bearing member 31 from the developing frame 21;

(3) a step of detaching the developing roller 23 from the developing frame 21;

(4) a step of detaching the developing blade 24 from the developing frame 21;

(5) a step of attaching the bearing member 31 to the developing frame 21;

(6) a step of attaching the developing blade 24 to the developing frame 21;

(7) a step of fastening the screws 55 to the developing frame 21 and the resin molded portion 40;

(8) a step of attaching the developing roller 23 to the developing frame 21; and (9) a step of attaching the bearing member 39 to the developing frame 21.

Each step in the reproduction method for the developing unit D will be described in detail below.

<(1) Step of Detaching the Screws 50 from the Developing Frame 21 and the Resin Molded Portion 40>

Figure 26:
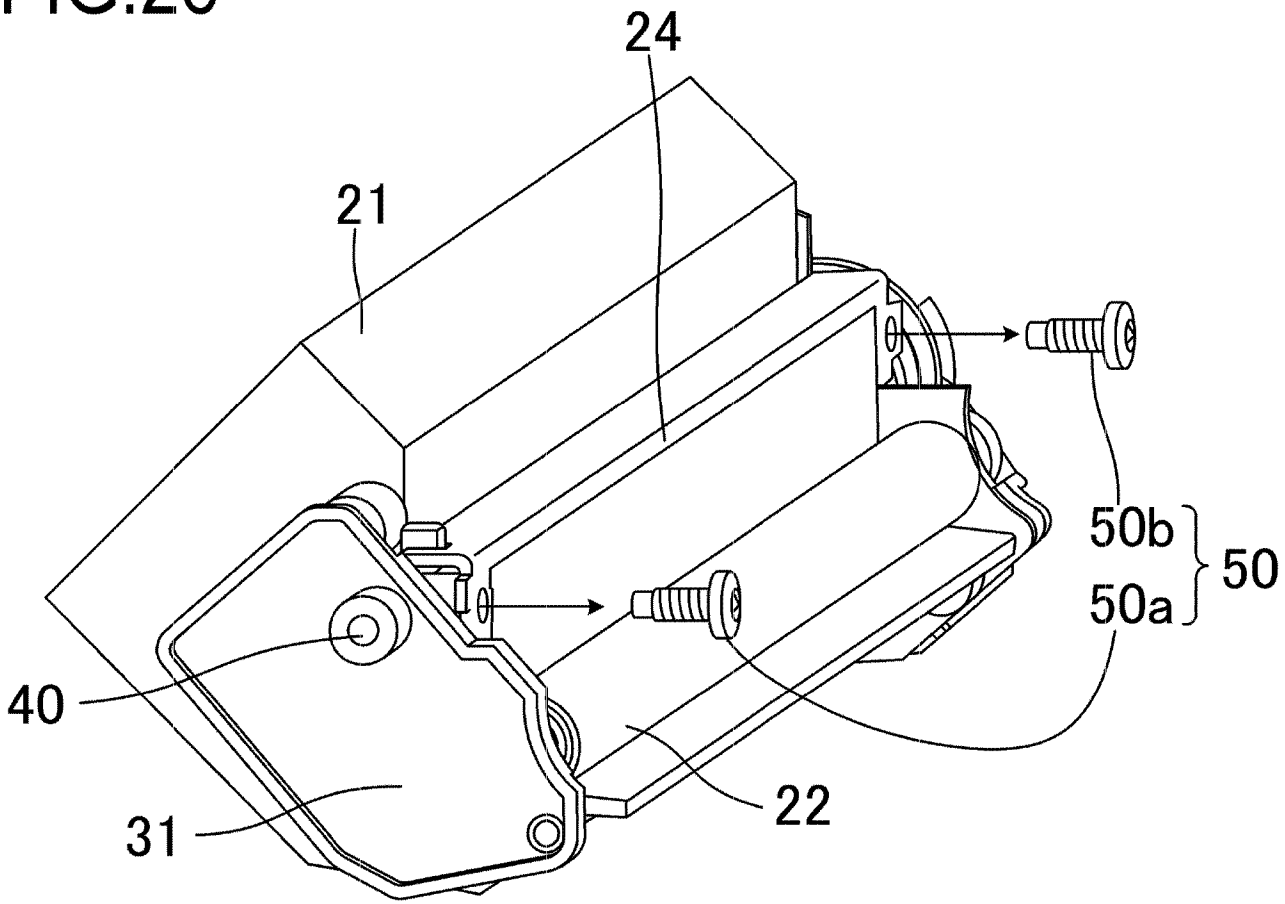
FIG. 26 is a perspective view showing how the screw is detached from the developing frame according to Example 4.
Figure 27:
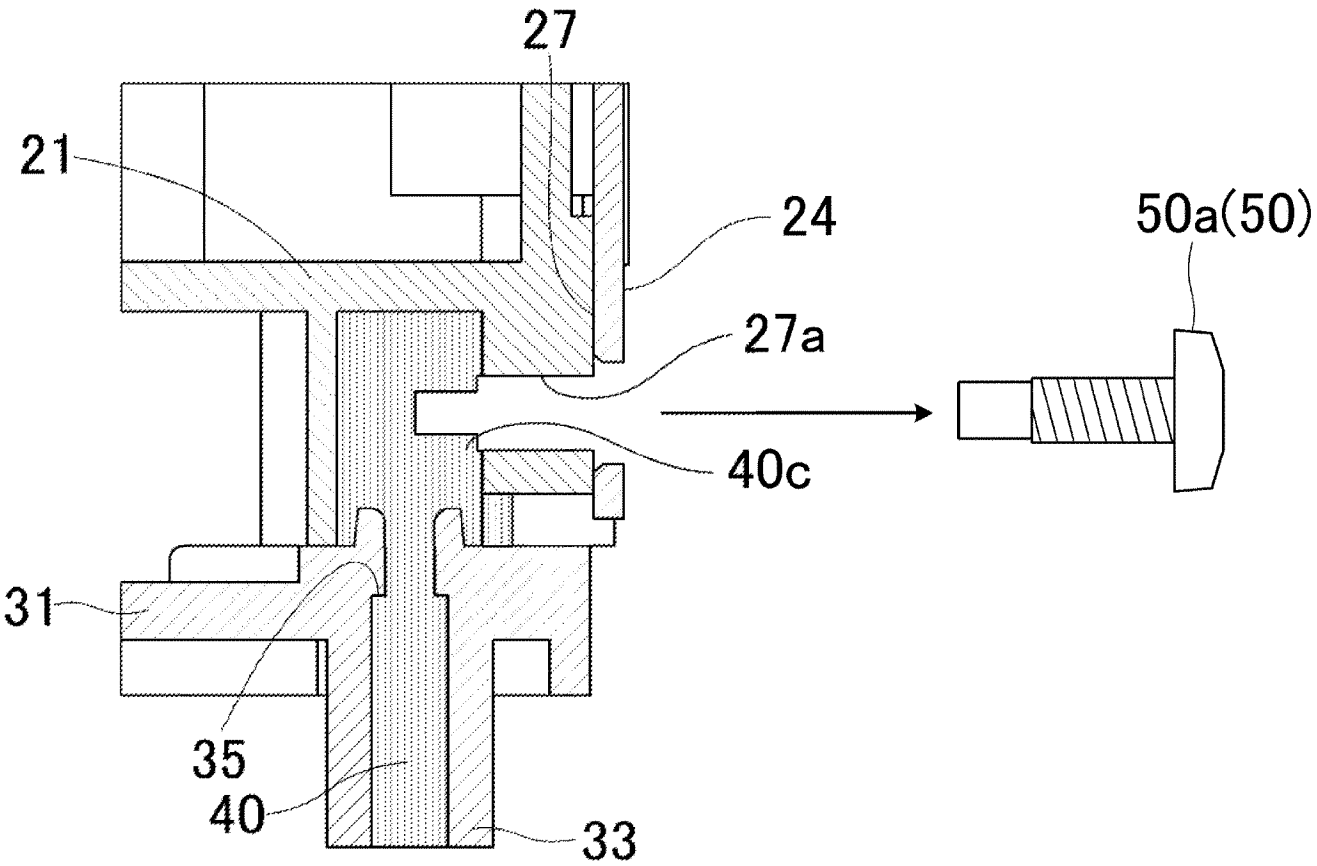
FIG. 27 is a cross-sectional view showing how the screw is detached from the developing frame according to Example 4.

A step of detaching (releasing the engagement (screwing) of) the screws 50 from the developing frame 21 and the resin molded portion 40 will be described hereinbelow with reference to FIGS. 26 and 27. FIG. 26 is a perspective view showing how the screws 50 (screw 50*a*, screw 50*b*) are detached from the developing frame 21. Further, FIG. 27 is a cross-sectional view showing how the screw 50*a* is detached from the developing frame 21.

In this step, as shown in FIG. 26, two screws 50 (screw 50*a*, screw 50*b*) fixing the developing blade 24 to the developing frame 21 are detached from the developing frame 21. The screw 50*a* is provided at a position close to the bearing member 31, and in this step, the screw 50*a* is detached from the developing frame 21 and the resin molding portion 40. At this time, as shown in FIG. 27, in the resin molded portion 40, the recessed portion 40*c* (corresponds to the screw hole) engaged with the screw 50*a* is exposed. In this step, the developing blade 24 is not yet detached from the developing frame 21 at this point of time.

<(2) Step of Detaching the Bearing Member 31 from the Developing Frame 21>

Figure 28:
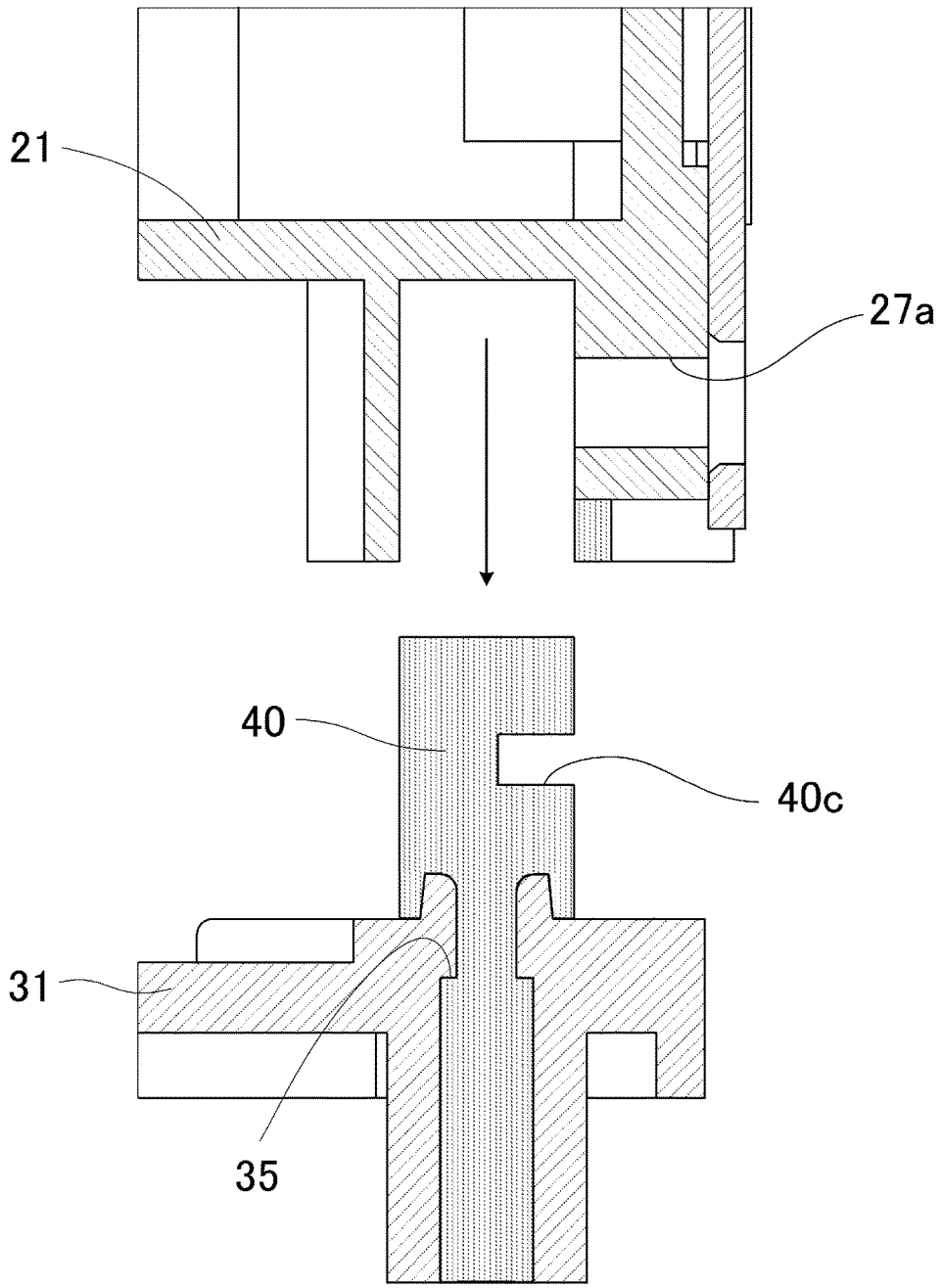
FIG. 28 is a cross-sectional view showing how the bearing member is detached from the developing frame according to Example 4.

The step of detaching the bearing member 31 from the developing frame 21 will be described hereinbelow with reference to FIG. 28. The manner of detaching the bearing member 31 from the developing frame 21 is the same as shown in FIG. 11 in Example 1. Further, FIG. 28 is a cross-sectional view showing how the bearing member 31 is detached from the developing frame 21. This step is the same as that in Example 1, and explanation thereof is herein omitted.

<(3) Step of Detaching the Developing Roller 23 from the Developing Frame 21>

The manner of detaching the developing roller 23 from the developing frame 21 is the same as shown in FIG. 13 in Example 1. This step is the same as that in Example 1, and explanation thereof is herein omitted.

<(4) Step of Detaching the Developing Blade 24 from the Developing Frame 21>

The manner of detaching the developing blade 24 from the developing frame 21 is the same as shown in FIG. 14 in Example 1. This step is the same as that in Example 1, and explanation thereof is herein omitted.

<(5) Step of Attaching the Bearing Member 31 to the Developing Frame 21>

Figure 29:
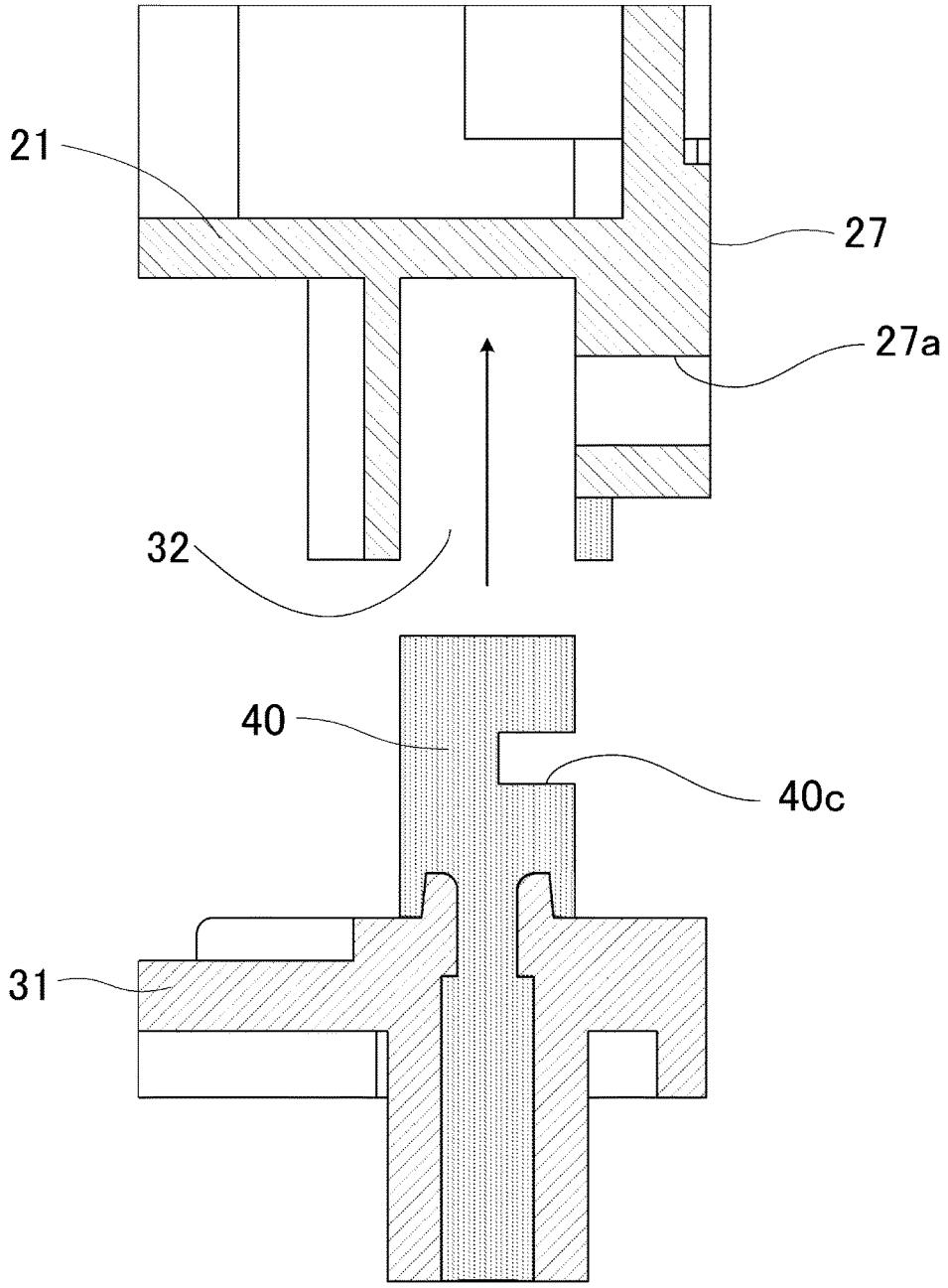
FIG. 29 is a cross-sectional view showing how the bearing member according to Example 4 is attached to the developing frame.

The manner of attaching the bearing member 31 to the developing frame 21 is the same as shown in FIG. 15A in Example 1. Further, FIG. 29 is a cross-sectional view showing how the bearing member 31 according to Example 4 is attached to the developing frame 21. This step is the same as that in Example 1, and explanation thereof is herein omitted.

<(7) Step of Fixing the Developing Blade 24 to the Developing Frame 21>

Figure 30:
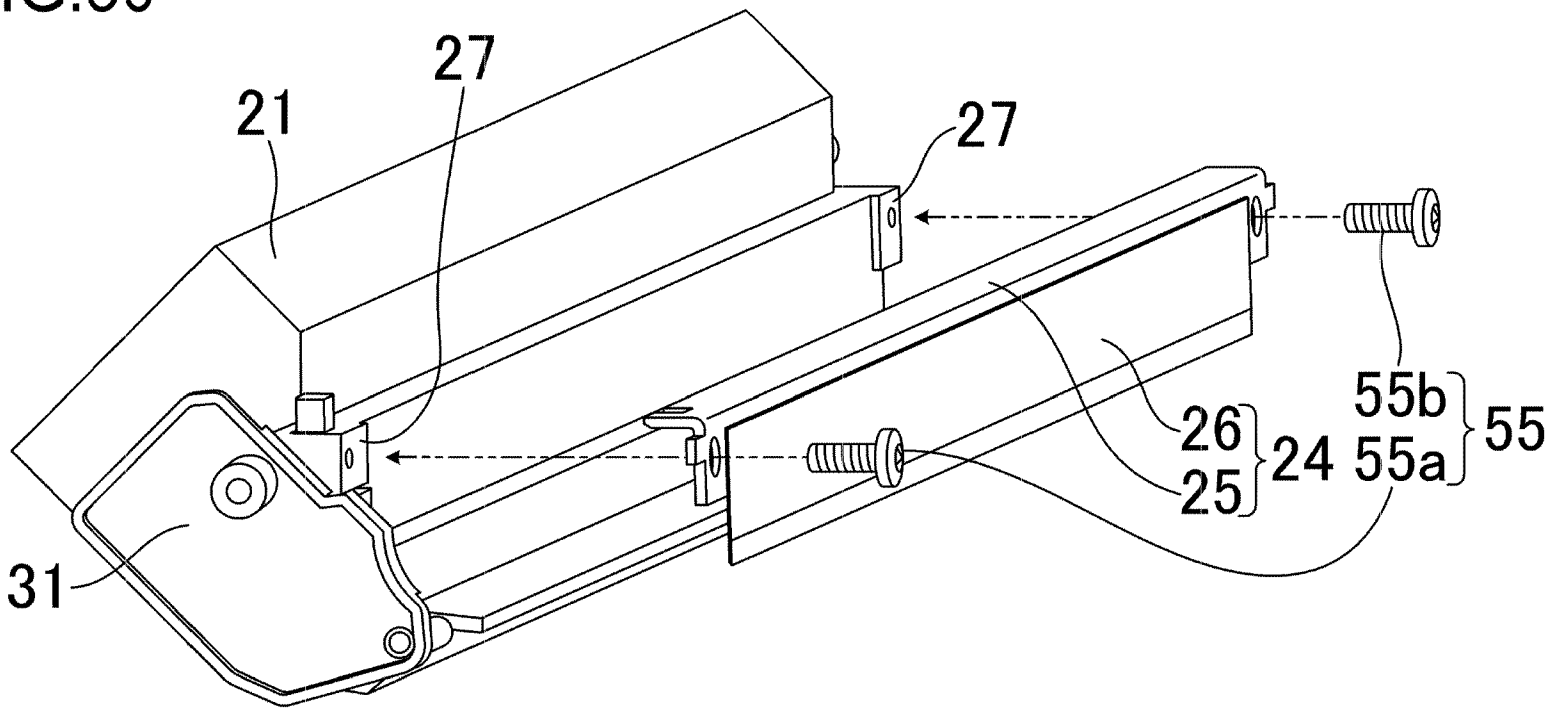
FIG. 30 is a perspective view showing how the developing blade according to Example 4 is attached to the developing frame.

FIG. 30 is a perspective view showing how the developing blade 24 according to Example 4 is positioned with respect to the developing frame 21. In this step, the developing blade 24 is attached to the developing frame 21 by using the screws 55. First, as shown in FIG. 30, the developing blade 24 is brought into contact with the two seating surfaces 27 provided in the developing frame 21. Next, the developing blade 24 is fixed to the developing frame 21 by using two screws 55 (screw 55*a*, screw 55*b*). Specifically, the screws 55 are passed through holes provided in the developing blade 24, and the screws 55 are engaged with the resin molded portion 40, thereby fixing the developing blade 24 to the developing frame 21.

At this time, in this example, as shown in FIGS. 22A and 22B, the outer diameter (first tip outer diameter) of the screw tip 51 (located near the end portion) of the screw 50 is set to be smaller than the outer diameter (second tip outer diameter) of the threaded portion (the portion in contact with the resin molded portion 40) of the screw 50. Meanwhile, the screw 55 is uniformly threaded from the tip portion to the other end portion of the screw so that the outer diameter of the screw tip 56*a* of the screw 55 is the same as the outer diameter of the threaded portion of the screw 55. Thus, unlike the screw 50, the outer diameter of the screw tip 56*a* of the screw 55 is not smaller than the outer diameter of the threaded portion of the screw 55. Further, when comparing the screw 50 and the screw 55, the outer diameter of the threaded portion of the screw 50 is the same as the outer diameter of the threaded portion of the screw 55. Meanwhile, the outer diameter of the screw tip 56*a* of the screw 55 is larger than the outer diameter of the screw tip 51 of the screw 50.

Therefore, when the screw 55 is inserted (screwed) into the recessed portion 40*c* in the resin molded portion 40, the screw tip 56*a* which is a threaded portion engages with the resin molded portion 40 and the resin molded portion 40 and the screw 55 are firmly fixed. Further, since the resin molded portion 40 and the screw 55 are electrically connected to each other in a stable manner, electric power is stably supplied from the power supply member (not shown in the figure) to the metal support sheet 25 through the resin molded portion 40. Further, when attaching the developing blade 24 to the developing frame 21 with satisfactory accuracy, the developing blade 24 may be provisionally fastened with two screws 55, and the developing blade 24 may be fixed to the developing frame 21 while measuring the position of the tip of the developing blade 24.

<(8) Step of Attaching the Developing Roller 23 to the Developing Frame 21>

The manner of attaching the developing roller 23 to the developing frame 21 is the same as shown in FIG. 18 in Example 1. This step is the same as that in Example 1, and explanation thereof is herein omitted.

<(9) Step of Attaching the Bearing Member 39 to the Developing Frame 21>

The step of attaching the bearing member 39 to the developing frame 21 is the same as that of Example 1, and explanation thereof is herein omitted. At this time, the manner of attaching the bearing member 39 to the developing frame 21 is the same as shown in FIG. 19 in Example 1.

As described above, in the present example, the outer diameter of at least a part of the threaded portion of the screw 55 is larger than the outer diameter of the threaded portion of the screw 50. Therefore, when the disassembled developing frame 21 and the bearing member 31 are joined to each other again, the bearing member 31 can be accurately positioned with respect to the developing frame 21.

Example 5

Figure 31A:
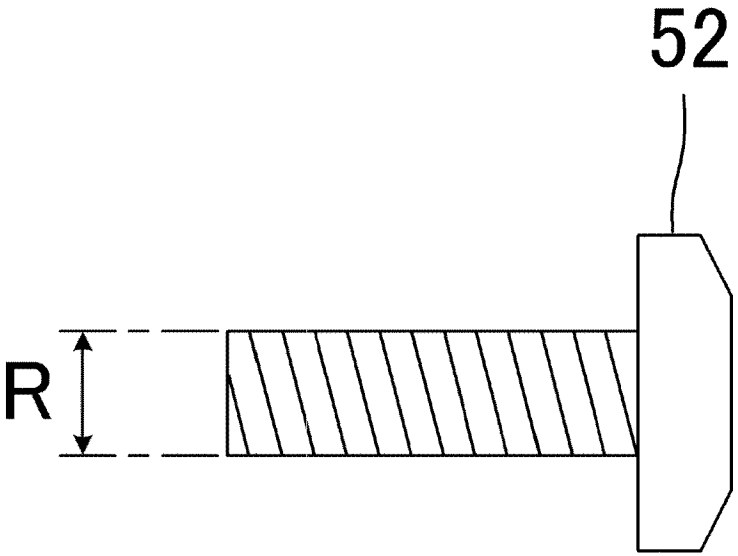
FIGS. 31A and 31B are views showing a screw for fixing the developing blade to the developing frame according to Example 5.
Figure 31B:
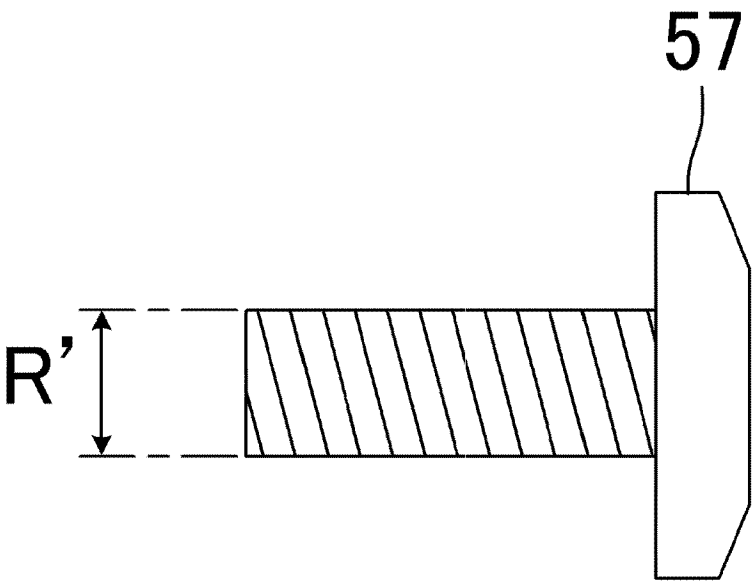

Next, Example 5 will be described. In this example, the method of reproducing the developing unit D is the same as in Example 1. However, in the present example, the bearing member 31 is fixed again to the developing frame 21 by using a screw 57 different from that of Example 1. FIGS. 31A and 31B are views showing respectively a screw 52 and a screw 57 for fixing the developing blade 24 according to Example 5 to the developing frame 21.

FIG. 31A is a view showing the screw 52 (corresponds to the first fixing member and the first screw member) according to Example 5. FIG. 31B is a view showing the screw 57 (corresponds to the second fixing member and the second screw member) according to Example 5.

In the present example, the bearing member 31 is detached from the developing frame 21 by pulling out the screws 52 from the resin molded portion 40. Further, by inserting the screws 57 into the resin molded portion 40, the bearing member 31 is again fixed to the developing frame 21. Here, in the present example, unlike the screw 50 according to Example 1, the screw 52 is not formed to have a portion with an outer diameter less than that of the threaded portion. In the screw 52, a threaded portion is formed substantially over the entire region of the screw 52. Further, the outer diameter of the threaded portion of the screw 52 is constant.

Here, in the present example, the outer diameter R' of the threaded portion of the screw 57 for fixing again the bearing member 31 to the developing frame 21 is larger than the outer diameter R of the threaded portion of the screw 52. Specifically, in this example, the screw 52 is M3 (screw having the diameter of the threaded portion of 3 mm), and the screw 57 is M4 (screw having the diameter of the threaded portion of 4 mm). As a result, when the bearing member 31 is again fixed to the developing frame 21, the resin molded portion 40 and the screw 57 are firmly fixed. As a consequence, since the resin molded portion 40 and the screw 57 are electrically connected in a stable manner, electric power is stably supplied from the power supply member (not shown in the figure) to the metal support sheet 25 through the resin molded portion 40.

As described above, in the present example, similarly to Example 4, in the case where the disassembled developing frame 21 and bearing member 31 are joined again, the bearing member 31 can be accurately positioned with respect to the developing frame 21.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Applications No. 2016-132392, filed on Jul. 4, 2016 and No. 2016-132399, filed on Jul. 4, 2016, which are hereby incorporated by reference herein in their entirety.

What is claimed is:

1. A reproduction method for a developing device including:

a frame of the developing device;

a developer carrying member that carries developer;

a bearing member that rotatably supports the developer carrying member;

a fixing member having electric conductivity, the fixing member provided so as to pass through a through hole provided in the frame; and a resin member having electric conductivity, the resin member fixed to the bearing member and engaged with the fixing member, the reproduction method comprising:

releasing the engagement between the fixing member and the resin member and separating the bearing member and the resin member from the frame;

replacing parts to be used in the developing device or replenishing the developing device with developer;

connecting the bearing member and the resin member to the frame; and inserting a fixing member having electric conductivity into the through hole to engage with the resin member and fix the resin member to the frame, thereby fixing the bearing member to the frame, wherein, when the bearing member and the resin member are fixed to the frame again after separating the bearing member and the resin member from the frame, a conductive member having conductivity is attached to at least one of the fixing member and the resin member so that the conductive member is interposed between the resin member and the fixing member.

2. The reproduction method for a developing device according to claim 1, wherein the developing device further includes a regulating member that regulates an amount of the developer carried on the developer carrying member; and the fixing member fixes the regulating member to the frame.

3. The reproduction method for a developing device according to claim 2, wherein the resin member and the regulating member are electrically connected through the fixing member; and electric power is supplied to the resin member to supply power to the regulating member.

4. The reproduction method for a developing device according to claim 1, wherein the conductive member is a grease.

5. A reproduction method for a developing device including:

a frame of the developing device;

a developer carrying member that carries developer;

a bearing member that rotatably supports the developer carrying member;

a fixing member provided so as to pass through a through hole provided in the frame; and a resin member fixed to the bearing member and engaged with the fixing member, the reproduction method comprising:

releasing the engagement between the fixing member and the resin member and separating the bearing member and the resin member from the frame;

replacing parts to be used in the developing device or replenishing the developing device with developer;

connecting the bearing member and the resin member to the frame; and inserting a fixing member into the through hole to engage with the resin member and fix the resin member to the frame, thereby fixing the bearing member to the frame, wherein, when the bearing member and the resin member are fixed to the frame again after separating the bearing member and the resin member from the frame, the fixing member is heated, and is inserted into the through hole of the frame so that the fixing member is brought into contact with the resin member, and the resin member is melted and then solidified again, thereby fixing the fixing member and the resin member.

6. A reproduction method for a developing device including:

a frame of the developing device;

a developer carrying member that carries developer;

a bearing member that rotatably supports the developer carrying member;

a first fixing member having electric conductivity, the first fixing member provided so as to pass through a through hole provided in the frame; and a resin member having electric conductivity, the resin member fixed to the bearing member and engaged with the first fixing member, the reproduction method comprising:

releasing the engagement between the first fixing member and the resin member and separating the bearing member and the resin member from the frame;

replacing parts to be used in the developing device or replenishing the developing device with developer;

connecting the bearing member and the resin member to the frame; and inserting a second fixing member having electric conductivity into the through hole to engage with the resin member and fix the resin member to the frame, thereby fixing the bearing member to the frame, wherein the first fixing member is a first screw member, and the second fixing member is a second screw member, and wherein an outer diameter of the second screw member at a portion with the resin member is larger than an outer diameter of at least a part of a portion of the first screw member that contacts the resin member.

7. The reproduction method for a developing device according to claim 6, wherein, when an outer diameter in the vicinity of an end portion of a threaded portion of the first screw member in a direction in which the first screw member is inserted is taken as a first tip outer diameter, and an outer diameter in the vicinity of an end portion of a threaded portion of the second screw member in a direction in which the second screw member is inserted is taken as a second tip outer diameter, the first tip outer diameter is smaller than the second tip outer diameter.

8. The reproduction method for a developing device according to claim 7, wherein the outer diameter of the threaded portion of the first screw member is constant, the outer diameter of the threaded portion of the second screw member is constant, and the outer diameter of the threaded portion of the second screw member is larger than the outer diameter of the threaded portion of the first screw member.

* * * * *